US006573223B1

(12) United States Patent
Vinci

(10) Patent No.: US 6,573,223 B1
(45) Date of Patent: Jun. 3, 2003

(54) LUBRICATING COMPOSITIONS WITH GOOD THERMAL STABILITY AND DEMULSIBILITY PROPERTIES

(75) Inventor: James N. Vinci, Mayfield Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/090,241

(22) Filed: Mar. 4, 2002

(51) Int. Cl.[7] ..... C10M 141/06; C10M 141/10

(52) U.S. Cl. ..... 508/192; 508/272; 508/282; 508/435; 508/436; 508/569

(58) Field of Search ..... 508/192, 272, 508/282, 435, 436, 569, 565

(56) References Cited

U.S. PATENT DOCUMENTS

| | | | | |
|---|---|---|---|---|
| 1,815,022 | A | 7/1931 | Davis | |
| 2,015,748 | A | 10/1935 | Frolich | 260/168 |
| 2,191,125 | A | 2/1940 | Collins | 180/79 |
| 2,191,498 | A | 2/1940 | Reiff | 87/9 |
| 2,387,501 | A | 10/1945 | Dietrich | 252/47.5 |
| 2,444,328 | A | 6/1948 | Blair, Jr. | 260/404.8 |
| 2,482,760 | A | 9/1949 | Goebel | 260/419 |
| 2,482,761 | A | 9/1949 | Goebel | 260/407 |
| 2,655,479 | A | 10/1953 | Munday et al. | 252/56 |
| 2,666,746 | A | 1/1954 | Munday et al. | 252/56 |
| 2,703,784 | A | 3/1955 | Fields | 252/32.7 |
| 2,708,199 | A | 5/1955 | Eby | 260/327 |
| 2,719,125 | A | 9/1955 | Roberts | 252/46.7 |
| 2,719,126 | A | 9/1955 | Fields et al. | 252/47 |
| 2,721,877 | A | 10/1955 | Popkin et al. | 260/485 |
| 2,721,878 | A | 10/1955 | Popkin | 260/485 |
| 2,731,481 | A | 1/1956 | Harrison et al. | 260/407 |
| 2,749,311 | A | 6/1956 | Sabol et al. | 252/32.7 |
| 2,760,933 | A | 8/1956 | Fields et al. | 252/32.7 |
| 2,764,547 | A | 9/1956 | Fields | 252/32.7 |
| 2,765,289 | A | 10/1956 | Fields et al. | 252/32.7 |
| 2,793,219 | A | 5/1957 | Barrett et al. | 260/407 |
| 2,799,652 | A | 7/1957 | Fields | 252/32.7 |
| 2,836,564 | A | 5/1958 | Roberts et al. | 252/47.5 |
| 2,850,453 | A | 9/1958 | Fields | 252/32.7 |
| 2,910,439 | A | 10/1959 | Fields | 252/46.7 |
| 2,964,545 | A | 12/1960 | Harrison | 260/407 |
| 2,976,468 | A | 3/1961 | Rouse | 318/138 |
| 3,000,916 | A | 9/1961 | Klass et al. | 260/404.5 |
| 3,087,932 | A | 4/1963 | Little, Jr. | 260/302 |
| 3,087,936 | A | 4/1963 | Le Suer | 260/326.3 |
| 3,087,937 | A | 4/1963 | Tesi et al. | 260/349 |
| 3,157,681 | A | 11/1964 | Fischer | 260/407 |
| 3,215,707 | A | 11/1965 | Rense | 260/326.3 |
| 3,219,666 | A | 11/1965 | Norman et al. | 260/268 |
| 3,231,587 | A | 1/1966 | Rense | 260/346.8 |
| 3,250,715 | A | 5/1966 | Wyman | 252/56 |
| 3,254,025 | A | 5/1966 | Le Suer | 252/32.7 |
| 3,256,304 | A | 6/1966 | Fischer et al. | 260/407 |
| 3,282,955 | A | 11/1966 | Le Suer | 260/326.3 |
| 3,313,727 | A | 4/1967 | Peeler | 252/18 |
| 3,438,757 | A | 4/1969 | Honnen et al. | 44/58 |
| 3,454,555 | A | 7/1969 | van der Voort et al. | 260/239 |
| 3,471,404 | A | 10/1969 | Myers | 252/45 |
| 3,491,025 | A | 1/1970 | Lee | 252/49.6 |
| 3,522,179 | A | 7/1970 | Le Suer | 252/51.5 |
| 3,533,945 | A | 10/1970 | Vogel | 252/49.6 |
| 3,565,804 | A | 2/1971 | Honnen et al. | 252/50 |
| 3,663,561 | A | 5/1972 | Blaha | 260/302 SD |
| 3,666,662 | A | 5/1972 | Lowe | 252/33.6 |
| 3,691,076 | A | 9/1972 | Johnston et al. | 252/59 |
| 3,755,433 | A | 8/1973 | Miller et al. | 252/51.5 |
| 3,804,763 | A | 4/1974 | Meinhardt | 252/51 |
| 3,822,289 | A | 7/1974 | Clark et al. | 260/332.8 |
| 3,840,549 | A | 10/1974 | Blaha et al. | 260/302 SD |
| 3,862,798 | A | 1/1975 | Hopkins | 350/278 |
| 3,877,899 | A | 4/1975 | Bundy et al. | 55/272 |
| 3,912,764 | A | 10/1975 | Palmer, Jr. | 260/346.8 |
| 3,948,800 | A | 4/1976 | Meinhardt | 252/356 |
| 3,957,854 | A | 5/1976 | Miller | 260/482 R |
| 3,980,569 | A | 9/1976 | Pindar et al. | 252/51.5 R |
| 4,110,349 | A | 8/1978 | Cohen | 260/346.74 |
| 4,119,549 | A | 10/1978 | Davis | 252/45 |
| 4,119,550 | A | 10/1978 | Davis | 252/45 |
| 4,136,043 | A | 1/1979 | Davis | 252/47.5 |
| 4,140,643 | A | 2/1979 | Davis | 252/47.5 |
| 4,191,659 | A | 3/1980 | Davis | 252/45 |
| 4,234,435 | A | 11/1980 | Meinhardt et al. | 252/51.5 A |
| 4,344,854 | A | 8/1982 | Davis | 252/45 |
| 4,454,059 | A | 6/1984 | Pindar et al. | 252/51.5 |
| 4,582,618 | A | 4/1986 | Davis | 252/32.7 |
| 4,612,129 | A | 9/1986 | DiBiase et al. | 252/33.6 |
| 4,670,169 | A | 6/1987 | Adams et al. | 252/46.7 |
| 4,755,311 | A | 7/1988 | Burjes et al. | 252/49.3 |
| 4,770,807 | A | 9/1988 | Musikas et al. | 252/184 |
| 4,876,374 | A | 10/1989 | Adams et al. | 558/109 |
| 4,904,401 | A | 2/1990 | Ripple et al. | 252/32.7 E |
| 4,925,983 | A | 5/1990 | Steckel | 564/8 |

(List continued on next page.)

FOREIGN PATENT DOCUMENTS

| | | |
|---|---|---|
| GB | 1 440 219 | 9/1973 |
| WO | WO 86/05501 | 9/1986 |
| WO | WO87/07638 | 12/1987 |
| WO | WO 88/03551 | 5/1988 |

*Primary Examiner*—Jacqueline V. Howard
(74) *Attorney, Agent, or Firm*—Teresan W. Gilbert; Michael F. Esposito; David M. Shold

(57) ABSTRACT

The invention relates to a lubricating composition comprising: (a) at least one sulfur-free hydrocarbyl phosphoric acid ester or salt, (b) at least one sulfur-containing hydrocarbyl phosphoric acid or salt, (c) an organic polysulfide, (d) at least one dispersant, and (e) at least one triazole metal deactivator. The composition may also include a thiadiazole derivative. This additive combination provides good antiwear and thermal stability properties, even under severe thermal conditions. These compositions also have good demulsibility properties. The above combination of additives provides the antiwear and extreme-pressure protection necessary for automotive and industrial gear applications. These additives additionally provide this protection without adversely effecting demulsibility properties of the lubricant.

16 Claims, No Drawings

U.S. PATENT DOCUMENTS 4,938,881 A 7/1990 Ripple et al. ..... 252/32.7 E
4,952,328 A 8/1990 Davis et al. ..... 252/32.7
4,957,649 A 9/1990 Ripple et al. ..... 252/32.7 E
5,230,714 A 7/1993 Steckel ..... 44/432
5,328,619 A * 7/1994 Conary ..... 508/192
5,354,484 A * 10/1994 Schwind et al. ..... 508/192
5,358,650 A * 10/1994 Srinivasan et al. ..... 508/282
5,360,562 A * 11/1994 Chrisope et al. ..... 508/282

* cited by examiner

LUBRICATING COMPOSITIONS WITH GOOD THERMAL STABILITY AND DEMULSIBILITY PROPERTIES

FIELD OF THE INVENTION

This invention relates to lubricating compositions that are useful as industrial or automotive gear lubricants. These compositions provide antiwear/extreme-pressure protection, thermally stability, and have good demulsifying properties.

BACKGROUND OF THE INVENTION

For gear assemblies in the automotive and industrial gear areas, one major problem for lubricating compositions is providing antiwear and extreme-pressure protection. Each of these different type gear assemblies pose a different wear problem for lubricants. When a single lubricant provides protection for both these areas, it is known as a Universal gear oil. It is difficult to provide a lubricating composition that can provide protection to both the automotive gear assembly, with it high shearing and shock loading wear problems, and industrial gear assemblies that have rolling wear from it spur gears.

In addition to antiwear and extreme pressure protection as well as stability, including oxidation and thermal stability issues, lubricating compositions in the universal gear oils such as those used in the automotive and industrial gear oil areas must provide protection for the soft metal components of the gears. These soft metal components are typically copper and brass related components of the equipment. Traditionally copper deactivators have been added to prevent adverse effects of the lubricating composition, especially the organic polysulfides on the copper and soft metal components. Triazoles have been used as one of these additives. However, triazoles adversely effect the lubricating composition's ability to provide protection under shock-loading conditions such as those measured in the SAE L-42 test.

Cleanliness is a measure of the stability of the lubricant and is measured as results in the SAE L-60-1 test. At automotive gear oil treatment levels, the lubricant must provide a level of cleanliness acceptable in these tests. One approach for controlling cleanliness in an engine is to provide a dispersant to the lubricating compositions. The dispersant acts to suspense sludge and soot particles and emulsify the lubricating compositions.

It is difficult for lubricant formulators to provide an additive combination that is effective as a universal lubricant in both automotive and industrial gears. Additionally, it is difficult to provide additive combinations that provide the antiwear and extreme-pressure protection and have thermal stability without adversely effecting demulsibility properties of the lubricants. Further, it is difficult to provide protection for copper and soft metal components without adversely effecting the lubricant's ability to provide shock-loading protection. It is desirable to find a combination of additives that can provide performance under these various conditions.

SUMMARY OF THE INVENTION

The invention relates to a lubricating composition comprising: (a) at least one sulfur-free hydrocarbyl phosphoric acid ester or salt, (b) at least one sulfur-containing hydrocarbyl phosphoric acid or salt, (c) an organic polysulfide, (d) at least one dispersant, and (e) at least one triazole metal deactivator. The composition may also include a thiadiazole derivative. This additive combination provides good antiwear and thermal stability properties, even under severe thermal conditions. These compositions also have good demulsibility properties.

The above combination of additives provides the antiwear and extreme-pressure protection necessary for automotive and industrial gear applications. These additives additionally provide this protection without adversely effecting demulsibility properties of the lubricant.

DETAILED DESCRIPTION OF THE PREFERRED EMBODIMENTS

The term "hydrocarbyl" includes hydrocarbon as well as substantially hydrocarbon groups. Substantially hydrocarbon describes groups that contain heteroatom substituents that do not alter the predominantly hydrocarbon nature of the group. Examples of hydrocarbyl groups include the following:

(1) hydrocarbon substituents, i.e., aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups that, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents that will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, e.g., sulfur, oxygen, nitrogen and such substituents as, e.g., pyridyl, furyl, thienyl, imidazolyl, etc.

In general, no more than about 2, preferably no more than one, hetero substituent will be present for every 10 carbon atoms in the hydrocarbyl group. Typically, there will be no such heteroatom substituents in the hydrocarbyl group. Therefore, the hydrocarbyl group is purely hydrocarbon.

In the specification and appended claims, the term "lubricating composition" refers to the combination of an oil of lubricating viscosity plus additives. The percentages of components are by weight are based on the total amount of the additive and the oil of lubricating viscosity. If not specifically stated, the oil of lubricating viscosity makes up the balance of the lubricating composition.

The lubricating compositions have two phosphorus antiwear agents. The antiwear and/or extreme pressure properties are provided by the combination of the sulfur-free and sulfur-containing phosphoric acid esters. The phosphoric acid esters are each independently present in an amount from about 0.05% to about 5%, or from about 0.08% to about 3%, or from about 0.1% to about 1% by weight. In one embodiment, the lubricating composition is an automotive gear oil. In this embodiment the phosphoric acid ester are each independently present in an amount from about 0.05% to about 5%, or from about 0.07% to about 3%, or from about 0.1% to about 1% by weight. In another embodiment, the lubricating composition is an industrial gear oil. In this embodiment, the phosphoric acid esters are each independently present in an amount from about 0.01% to about 1%, or from about 0.05% to about 0.7%, or from about 0.8% to about 0.5% by weight. Here and elsewhere in the specification and claims, range and ratio limits may be combined. In one embodiment, the phosphorus esters are present in a weight ratio from about 0.5 to about 2, or from about 0.75 to about 1.5 or from about 1 part sulfur-free phosphoric acid ester to 1 part of sulfur-containing phosphoric acid ester.

Sulfur-free Phosphoric Acid Esters

The sulfur-free phosphoric acid esters are those lacking a sulfur phosphorus bond. These esters are, in one embodiment, free of sulfur atoms. These esters at present at an amount to provide antiwear and/or extreme pressure properties to the lubricating composition.

The sulfur-free phosphoric acid ester may be prepared by reacting one or more sulfur-free phosphorus acids or anhydrides with one or more alcohols containing from 1 to about 30, or from 2 to about 24, or from about 3 to about 12 carbon atoms. The phosphorus acid or anhydride is generally an inorganic phosphorus reagent, such as phosphorus pentoxide, phosphorus trioxide, phosphorus tetroxide, phosphorous acid, phosphoric acid, phosphorus halide, or one or more C1–7 phosphorus esters. The alcohols generally contain from one to about 30, or from two to about 24, or from about 3 to about 12, or up to about 8 carbon atoms. Alcohols used to prepare the phosphoric acid esters include butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of C18–C28 primary alcohols having mostly C20 alcohols as determined by GLC (gas-liquid-chromatography); and Alfol 22+ alcohols (C18–C28 primary alcohols containing primarily C22 alcohols). Alfol alcohols are available from Continental Oil Company. Another example of a commercially available alcohol mixtures are Adol 60 (about 75% by weight of a straight chain C22 primary alcohol, about 15% of a C20 primary alcohol and about 8% of C18 and C24 alcohols) and Adol 320 (oleyl alcohol). The Adol alcohols are marketed by Ashland Chemical.

A variety of mixtures of monohydric fatty alcohols derived from naturally occurring triglycerides and ranging in chain length of from C8 to C18 are available from Procter & Gamble Company. These mixtures contain various amounts of fatty alcohols containing mainly 12, 14, 16 or 18 carbon atoms. For example, CO-1214 is a fatty alcohol mixture containing 0.5% of C10 alcohol, 66.0% of C12 alcohol, 26.0% of C14 alcohol and 6.5% of C16 alcohol.

Another group of commercially available mixtures include the "Neodol" products available from Shell Chemical Co. For example, Neodol 23 is a mixture of C12 and C13 alcohols; Neodol 25 is a mixture of C12 and C15 alcohols; and Neodol 45 is a mixture of C14 to C15 linear alcohols. Neodol 91 is a mixture of C9, C10 and C11 alcohols.

Fatty vicinal diols also are useful and these include those available from Ashland Oil under the general trade designation Adol 114 and Adol 158. The former is derived from a straight chain alpha-olefin fraction of C11–C14, and the latter is derived from a C15–C18 alpha-olefin fraction.

The amine salt of a phosphoric acid ester is prepared by reacting a phosporic acid ester with ammonia or a basic nitrogen compound, such as an amine or a nitrogen containing dispersant. The salts may be formed separately, and then the salt of the phosphorus acid ester may be added to the lubricating composition. Alternatively, the salts may also be formed in situ when the acidic phosphorus acid ester is blended with other components to form a fully formulated lubricating composition.

The ammonium salts of the phosphorus acid esters may be formed from ammonia, or an amine, or mixtures thereof. These amines may be monoamines or polyamines. Useful amines include those disclosed in U.S. Pat. No. 4,234,435 at Col. 21, line 4 to Col. 27, line 50, incorporated herein by reference.

The monoamines generally contain from 1 to about 24, or from 1 to about 12, or from 1 to about 6 carbon atoms. Examples of monoamines include methylamine, ethylamine, propylamine, butylamine, 2-ethylhexylamine, octylamine, and dodecylamine. Examples of secondary amines include dimethylamine, diethylamine, dipropylamine, dibutylamine, methylbutylamine, ethylhexylamine, etc. Tertiary amines include trimethylamine, tributylamine, methyldiethylamine, ethyldibutylamine, etc.

In one embodiment, the amine is a fatty (C8–30) amine such as n-octylamine, n-decylamine, n-dodecylamine, n-hexadecylamine, n-octadecylamine, oleyamine, etc. Also fatty amines include "Armeen" amines (products available from Akzo Chemicals, Chicago, Illinois), such Armeen C, Armeen O, Armeen T, and Armeen S, wherein the letter designates the fatty group, such as coco, oleyl, tallow, or stearyl groups.

Other useful amines include primary ether amines, such as those represented by the formula, R"(ORN)xNH2, wherein RN is a divalent alkylene group having about 2 to about 6 carbon atoms; x is a number from 1 to about 150, or from about 1 to about 5, or 1; and R" is a hydrocarbyl group of about 5 to about 150 carbon atoms. An example of an ether amine is available under the name SURFAM® amines produced and marketed by Mars Chemical Company, Atlanta, Ga. Useful etheramines are exemplified by those identified as SURFAM P14B (decyloxypropylamine), SURFAM P16A (linear C16), SURFAM P17B (tridecyloxypropylamine). The carbon chain lengths (i.e., C14, etc.) of the SURFAMS described above and used hereinafter are approximate and include the oxygen ether linkage.

In one embodiment, the amine is a tertiary-aliphatic primary amine. Generally, the aliphatic group, generally an alkyl group, contains from about 4 to about 30, or from about 6 to about 24, or from about 8 to about 22 carbon atoms. Such amines are illustrated by t-butylamine, t-hexylamine, 1-methyl-1-amino-cyclohexane, t-octylamine, t-decylamine, t-dodecylamine, t-tetradecylamine, t-hexadecylamine, t-octadecylamine, t-tetracosanylamine, and t-octacosanylamine. The amine may be mixtures of tertiary aliphatic amines such as "Primene 81 R" (a mixture of C11–C14 tertiary alkyl primary amines) and "Primene JMT" (a mixture of C18–C22 tertiary alkyl primary amines). These amines are available from Rohm and Haas Company. The tertiary aliphatic primary amine useful for the purposes of this invention and methods for their preparation are described in U.S. Pat. No. 2,945,749, incorporated by reference for its teaching in this regard.

In one embodiment, the amine may be a hydroxyamine. Typically, the hydroxyamines are primary, secondary, or tertiary alkanol amines or mixtures thereof. Such amines can be represented by the formulae: H2)N)R')OH, H(R'1)N)R')OH, and (R'1)2)N)R')OH, wherein each R'1 is independently a hydrocarbyl group having from 1 to about 8 carbon atoms or hydroxyhydrocarbyl group having from one to about eight carbon atoms, or from one to about four, and R' is a divalent hydrocarbyl group of about 2 to about 18 carbon atoms, or from 2 to about 4. The group -R'-OH in such formulae represents the hydroxyhydrocarbyl group. R' can be an acyclic, alicyclic or aromatic group. Typically, R' is an acyclic straight or branched alkylene group, such as an ethylene, 1,2-propylene, 1,2-butylene, and 1,2-octadecylene groups. Where two R'1 groups are present in the same molecule they can be joined by a direct carbon-to-carbon bond or through a heteroatom (e.g., oxygen, nitrogen or sulfur) to form a 5-, 6-, 7- or 8-membered ring structure. Typically, however, each R'1 is independently a methyl, ethyl, propyl, butyl, pentyl or hexyl group. Examples of these alkanolamines include mono-, di-, and triethanolamine, diethylethanolamine, ethylethanolamine, butyldiethanolamine, etc.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl) amines can be conveniently prepared by reaction of one or more of the epoxides described herein with afore-described amines and may be represented by the formulae: H2N)(R'O)x)H, H(R'1))N)(R'O)x)H, and (R'1)2)N)(R'O)x)H, wherein x is a number from about 2 to about 15 and R'1 and R' are as described above. R'1 may also be a hydroxypoly(hydrocarbyloxy) group. Useful hydroxyhydrocarbyl amines include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof.

In one embodiment, the amine may be a hydroxyhydrocarbyl amine. These hydroxyhydrocarbyl amines are available from the Akzo Chemical Division of Akzona, Inc., Chicago, Ill., under the general trade designations "Ethomeen" and "Propomeen." Specific examples of such products include: Ethomeen C/15; Ethomeen C/20 and C/25; Ethomeen O/12; Ethomeen S/15 and S/20; Ethomeen T/12, T/15 and T/25; and Propomeen O/12.

The amine may also be a polyamine. The polyamines include alkoxylated diamines, fatty polyamine diamines, alkylenepolyamines, hydroxy containing polyamines, condensed polyamines, arylpolyamines, and heterocyclic polyamines. Commercially available examples of alkoxylated diamines include Ethoduomeen T/13 and T/20, which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylenediamines, propanediamines (1,2 or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

In another embodiment, the amine is an alkylenepolyamine. Alkylenepolyamines are represented by the formula HR4N-(Alkylene-N)n-(R4)2, wherein each R4 is independently hydrogen; or an aliphatic or hydroxy-substituted aliphatic group of up to about 30 carbon atoms; n is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, R4 is defined the same as R'1 above. Such alkylenepolyamines include methylenepolyamines, ethylenepolyamines, butylenepolyamines, propylenepolyamines, pentylenepolyamines, etc. Specific examples of such polyamines are ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment, the polyamine is an ethylenepolyamine. Such polyamines are described in detail under the heading Ethylene Amines in Kirk Othmer's "Encyclopedia of Chemical Technology," 2d Edition, Vol. 7, pages 22–37, Interscience Publishers, New York (1965). Ethylenepolyamines are often a complex mixture of polyalkylenepolyamines including cyclic condensation products. Other useful types of polyamine mixtures are those resulting from stripping of the above-described polyamine mixtures to leave, as residue, what is often termed "polyamine bottoms." In general, alkylenepolyamine bottoms can be characterized as having less than 2%, usually less than 1% (by weight) material boiling below about 200° C. A typical sample of such ethylenepolyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetraamine, 21.74% tetraethylenepentaamine and 76.61% pentaethylenehexamine and higher analogs. These alkylenepolyamine bottoms include cyclic condensation products such as piperazine and higher analogs of diethylenetriamine, triethylenetetramine and the like. These alkylenepolyamine bottoms may be reacted solely with the acylating agent or they may be used with other amines, polyamines, or mixtures thereof.

Another useful polyamine is a condensation reaction between at least one hydroxy compound with at least one polyamine reactant containing at least one primary or secondary amino group. The hydroxy compounds include polyhydric alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from 2 to about 4. Examples of polyhydric amines include tri-(hydroxypropyl)amine, tris-(hydroxymethyl)amino methane, 2-amino-2-methyl-1,3-propanediol, N,N,N',N'-tetrakis (2-hydroxypropyl) ethylenediamine, and N,N,N',N'-tetrakis (2-hydroxyethyl) ethylenediamine. Tris (hydroxymethyl) aminomethane (THAM) is particularly useful.

Polyamines that may react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms."

The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO 86/05501 and U.S. Pat. No. 5,230,714 (Steckel), incorporated by reference for its disclosure to the condensates and methods of making. A particularly useful amine condensate is prepared from HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and tris(hydroxymethyl) aminomethane (THAM).

In another embodiment, the polyamines are polyoxyalkylene polyamines, e.g. polyoxyalkylene diamines and polyoxyalkylene triamines, having average molecular weights ranging from about 200 to about 4000, or from about 400 to about 2000. The polyoxyalkylene polyamines are commercially available and may be obtained, for example, from the Jefferson Chemical Company, Inc. under the trade name "Jeffamines D-230, D-400, D-1000, D-2000, T-403, etc." U.S. Pat. Nos. 3,804,763 and 3,948,800 are expressly incorporated herein by reference for their disclosure of such polyoxyalkylene polyamines and acylated products made therefrom.

In another embodiment, the polyamines are hydroxy-containing polyamines. Hydroxy-containing polyamine analogs of hydroxy monoamines, particularly alkoxylated alkylenepolyamines, e.g., N,N-(diethanol)ethylene diamines can also be used. Such polyamines can be made by reacting the above-described alkylene amines with one or more of the alkylene oxides described herein. Similar alkylene oxide-alkanol amine reaction products may also be used such as the products made by reacting the above described primary, secondary or tertiary alkanol amines with ethylene, propylene or higher epoxides in a 1.1 to 1.2 molar ratio. Specific examples of hydroxy-containing polyamines include N-(2-hydroxyethyl) ethylenediamine, N,N'-bis(2-hydroxyethyl)-ethylenediamine, 1-(2-hydroxyethyl)piperazine, mono (hydroxypropyl)-substituted tetraethylenepentamine, N-(3-hydroxybutyl)-tetramethylene diamine, etc.

In another embodiment, the polyamine is a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines.

The following examples relate to amine salts of phosphoric acid esters. Unless the context indicates otherwise, temperatures are in degrees Celsius, pressure is atmospheric, and the parts and percentages are by weight.

EXAMPLE P-1

Alfol 8–10 (2628 parts, 18 moles) is heated to a temperature of about 45° C. whereupon 852 parts (6 moles) of phosphorus pentoxide are added over a period of 45 minutes while maintaining the reaction temperature between about 45–65° C. The mixture is stirred an additional 0.5 hour at this temperature, and is there-after heated at 70° C. for about 2–3 hours. Primene 81-R (2362 parts, 12.6 moles) is added dropwise to the reaction mixture while maintaining the temperature between about 30–50° C. When all of the amine has been added, the reaction mixture is filtered through a filter aid, and the filtrate is the desired amine salt containing 7.4% phosphorus (theory, 7.1%).

EXAMPLE P-2

To 1000 parts (3.21 moles) of an alkyl phosphoric acid ester mixture prepared as in Example P-1, there is added 454 parts (3.7 moles) of di-n-butyl amine and maintaining an atmosphere of nitrogen. Over the period of addition, the reaction mixture is heated to and maintained at a temperature of 120° C. After all of the butyl amine has been added, the mixture is maintained at 120° C. for 8 hours. The desired amine salt is obtained and contains 7.1% phosphorus (theory, 6.8%) and 3.4% nitrogen (theory, 3.6%).

EXAMPLE P-3

To 721.4 parts (2.31 moles) of an alkyl phosphoric acid mixture as prepared in Example P-1, there is added 613.7 parts (2.54 moles)of di-(2-ethylhexylamine) in an atmosphere of nitrogen. As the amine is added, the temperature of the reaction mixture rises from 20° C. to 120° C. The reaction mixture is maintained at this temperature for 5 hours to yield the desired product containing 3.4% phosphorus (theory, 3.0%) and 2.7% nitrogen (theory, 2.7%).

EXAMPLE P-4

A reaction vessel is charged with 793.4 parts (9 moles) of n-amyl alcohol, and 426 parts (3 moles) of phosphorus pentoxide is added over a period of 1.5 hours incrementally while maintaining the reaction temperature between about 55–70° C. After all of the phosphorus pentoxide has been added, the mixture is stirred for 0.5 hour. The reaction mixture then is maintained at 70° C. for 3 hours. Primene 81-R (1597.9 parts, 5.93 moles) is added dropwise to the reaction mixture while maintaining the temperature between 50–70° C. After all of the Primene 81-R has been added, the reaction mixture is filtered through a filter aid to yield the desired amine salt containing 6.1% phosphorus (theory, 5.8%).

Sulfur Containing Phosphoric Acid Ester

The lubricating compositions include at least one sulfur-containing phosphoric acid ester. The sulfur-containing phosphoric acid ester has one or more sulfur to phosphorus bonds. In one embodiment, the sulfur-containing phosphorus acid ester is referred to as a thiophosphorus acid or salt thereof. The thiophosphorus acid or salt may be prepared by reacting one or more phosphorus sulfides with alcohols, such as those described above. Useful phosphorus sulfide-containing sources include phosphorus pentasulfide, phosphorus sesquisulfide, phosphorus heptasulfide and the like. The thiophosphorus acid esters may be mono- or dithiophosphorus acid esters. Thiophosphorus acid esters are also referred to generally as dithiophosphates.

In one embodiment, the sulfur containing phosphorus acid ester is a phosphorus ester prepared by reacting one or more dithiophosphoric acid with an epoxide or a glycol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is particularly useful. The glycols may be aliphatic glycols, having from 1 to about 12, or from about 2 to about 6, or from about 2 to about 3 carbon atoms, or aromatic glycols. Glycols include ethylene glycol, propylene glycol, catechol, resorcinol, and the like. The dithiophosphoric acids, glycols, epoxides, inorganic phosphorus reagents and methods of reacting the same are described in U.S. Pat. Nos. 3,197,405 and 3,544,465, incorporated herein by reference for their disclosure to these.

In one embodiment, the sulfur-containing phosphorus acid ester is a monothiophosphoric acid. Monothiophosphic acids may be prepared by the reaction of a sulfur source with a dihydrocarbyl phosphite. The sulfur source may for instance be elemental sulfur, or a sulfide, such as a sulfur-coupled olefin or a sulfur-coupled dithiophosphate. Elemental sulfur is a good sulfur source. The preparation of monothiophosphoric acids is disclosed in U.S. Pat. No. 4,755,311 and PCT Publication WO 87/07638, incorporated herein by reference for their disclosure of monothiophosphoric acids, sulfur sources, and the process for making monothiophosphoric acids. Monothiophosphoric acids may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C., or higher) to form the monothiophosphoric acid.

In another embodiment, the sulfur-containing phosphorus acid ester is a dithiophosphoric acid or phosphorodithioic acid. The dithiophosphoric acid may be represented by the formula (R7O)2PSSH, wherein each R7 is independently a hydrocarbyl group containing from about 3 to about 30, or from about 3 up to about 18, or from about 4 up to about 12, or up to about 8 carbon atoms. Examples of R7 include isopropyl, isobutyl, n-butyl, sec-butyl, amyl, n-hexyl, methylisobutyl carbinyl, heptyl, 2-ethylhexyl, isooctyl, nonyl, behenyl, decyl, dodecyl, tridecyl, alkylphenyl groups, or mixtures thereof. Illustrative lower alkylphenyl R7 groups include butylphenyl, amylphenyl, and heptylphenyl and mixtures thereof. Examples of mixtures of R7 groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

In one embodiment, the sulfur-containing phosphoric acid esters are reacted with an unsaturated compound to form the sulfur-containing phosphorus esters. The unsaturated compounds include unsaturated amides, esters, acids, epoxides, and ethers. Examples of unsaturated amides include acrylamide, N,NN-methylene bis(acrylamide), methacrylamide, crotonamide, and the like. The reaction product of the phosphorus acid and the unsaturated amide may be further reacted with a linking or a coupling compound, such as formaldehyde or paraformaldehyde. Examples of phosphorus containing amides include the reaction product of di(methylamyl) dithiophosphoric acid and acrylamide and the reaction product of di(amyl) dithiophosphoric acid, acrylamide and paraformaldehyde. The phosphorus-containing amides are known in the art and are disclosed in U.S. Pat. Nos. 4,670,169, 4,770,807 and 4,876,374, incorporated by reference for their disclosures of phosphorus amides and their preparation.

In another embodiment, the unsaturated compound is an unsaturated carboxylic acid or ester. Examples of unsaturated carboxylic acids and anhydrides include acrylic acid or esters, methacrylic acid or esters, itaconic acid or esters, fumaric acid or esters, and maleic acid, anhydride, or esters. The esters may be represented by one of the formulae R8C═C(R9)C(O)OR10, or R10O—(O)C—HC═CH—C(O)OR10, wherein each R8 and R10 are independently hydrogen or a hydrocarbyl group having from 1 to about 18, or from 1 to about 12, or from 1 to about 8 carbon atoms, R9 is hydrogen or an alkyl group having from one to about six carbon atoms. In one embodiment, R9 is hydrogen or a methyl group. Examples of unsaturated carboxylic esters include methyl acrylate, ethyl acrylate, butyl acrylate, 2-ethylhexyl acrylate, 2-hydroxyethyl acrylate, 2-hydroxypropyl acrylate, methyl methacrylate, ethyl methacrylate, butyl methacrylate, 2-hydroxyethyl methacrylate, 2-hydroxypropyl methacrylate, ethyl maleate, butyl maleate and 2-ethylhexyl maleate. The above list includes mono- as well as diesters of maleic, fumaric and citraconic acids. If the carboxylic acid is used, the ester may then be formed by subsequent reaction of the phosphoric acid-unsaturated carboxylic acid adduct with an alcohol, such as those described above. Examples of phosphorus containing esters are the reaction product of isobutyl, amyl dithiophosphoric acid and methyl acrylate and di(amyl) dithiophosphoric acid and butyl methacrylate.

In another embodiment, the unsaturated compound is a vinyl ether. The vinyl ether is represented by the formula R11-CH2═CH—OR12, wherein R11 and R12 are independently hydrogen or a hydrocarbyl group having from 1 up to about 30, or from 1 up to about 24, or from 2 up to about 12 carbon atoms. Examples of vinyl ethers include methyl vinyl ether, propyl vinyl ether, 2-ethylhexyl vinyl ether and the like.

In another embodiment, the unsaturated compound is a vinyl ester. The vinyl ester may be represented by the formula R13CH═CH—O(O)CR14, wherein R13 is a hydrocarbyl group having from 1 to about 30, or from 1 to about 12 carbon atoms, or hydrogen, and R14 is a hydrocarbyl group having 1 to about 30, or from 1 to about 12, or from 1 to about 8 carbon atoms. Examples of vinyl esters include vinyl acetate, vinyl 2-ethylhexanoate, vinyl butanoate, etc.

The following Examples PS-1 through PS-5 exemplify the preparation of useful phosphorus acid esters and salts thereof.

EXAMPLE PS-1

Phosphorus pentoxide (64 grams) is added at 58° C. over a period of 45 minutes to 514 grams of hydroxypropyl O,O-di(4-methyl-2-pentyl)phosphorodithioate (prepared by reacting di(4-methyl-2-pentyl)phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulfur, and has an acid number of 87 (bromophenol blue).

EXAMPLE PS-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate contains 15.3% by weight phosphorus, 19.6% by weight sulfur, and has an acid number of 126 (bromophenol blue).

EXAMPLE PS-3

A reaction vessel is charged with 217 grams of the filtrate from Example PS-1. Primeen 81 R (66 grams) is added over a period of 20 minutes at 25–60° C. The resulting product has a phosphorus content of 10.2% by weight, a nitrogen content of 1.5% by weight, and an acid number of 26.3.

EXAMPLE PS-4

The filtrate of Example PS-2 (1752 grams) is mixed at 25–82° C. with 764 grams of the aliphatic primary amine used in of Example PS-3. The resulting product has 9.95% phosphorus, 2.72% nitrogen, and 12.6% sulfur.

EXAMPLE PS-5

Phosphorus pentoxide (208 grams) is added to the product prepared by reacting 280 grams of propylene oxide with 1184 grams of O,ON-di-isobutyl phosphorodithioic acid at 30–60° C. The addition is made at a temperature of 50–60° C. and the resulting mixture is then heated to 80° C. and held at that temperature for 2 hours. The commercial aliphatic primary amine identified in Example B-3 (384 grams) is added to the mixture, while the temperature is maintained in the range of 30–60° C. The reaction mixture is filtered through diatomaceous earth. The filtrate has 9.3% phosphorus, 11.4% sulfur, 2.5% nitrogen, and a base number of 6.9 (bromophenol blue indicator).

Organic Polysulfide

The lubricating compositions may include an organic polysulfide. Generally, the organic polysulfide is used in an amount from about 0.05% up to about 8%, or from about 0.1% up to about 6%, or from about 0.5% up to about 4% by weight of the lubricating composition. In one embodiment, the lubricating composition is an automotive gear oil. In this embodiment, the sulfur-containing phosphoric acid ester is present in an amount from about 0.5% up to about 8%, or from about 1% up to about 5%, or from about 2% up to about 4% by weight. In another embodiment, the lubricating composition is an industrial gear oil. In this embodiment, the sulfur-containing phosphoric acid ester is present in an amount from about 0.05% up to about 4%, or from about 0.1% up to about 3%, or from about 0.5% up to about 2% by weight. The organic polysulfides are generally characterized as having sulfur-sulfur linkages. Typically the linkages have from 2 to about 10 sulfur atoms, or from 2 to about 6 sulfur atoms, or from 2 to about 4 sulfur atoms. In one embodiment, the organic polysulfides are generally di-, tri- or tetrasulfide compositions, with trisulfide compositions useful. In another embodiment, the polysulfide is a mixture where the majority of the compounds in the mixture are tri- or tetrasulfides. Still, in another embodiment, the polysulfide is a mixture of compounds where at least about 60%, or at least about 70%, or at least about 80% of the compounds are trisulfide. The organic polysulfides provide from about 1% to about 3% by weight sulfur to the lubricating compositions. Generally, the organic polysulfides contain from about 10% to about 60% sulfur, or from about 20% to about 50%, or from about 35% to about 45% by weight sulfur.

Materials that may be sulfurized to form the organic polysulfides include oils, fatty acids or esters, or olefins, or polyolefins. Oils that may be sulfurized are natural or synthetic oils including mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids generally contain from about 8 to about 30, or from about 12 to about 24 carbon atoms. Examples of fatty acids include oleic, linoleic, linolenic, tall oil and rosin acids. Sulfurized fatty acid esters prepared from mixed unsaturated fatty acid esters such as are obtained from animal fats and vegetable oils, including tall oil, linseed oil, soybean oil, rapeseed oil, and fish oil, are also useful.

The olefinic compounds that may be sulfurized are diverse in nature. They contain at least one olefinic double bond, which is defined as a non-aromatic double bond. In its broadest sense, the olefin may be defined by the formula;

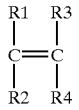

wherein each of R1, R2, R3 and R4 is hydrogen or an organic group. In general, the R groups in the above formula which are not hydrogen may be satisfied by such groups as —C(R5)3, —COOR5, —CON(R5)2, —COON(R5)4, —COOM, —CN, —X, —YR5 or —Ar, wherein: each R5 is independently hydrogen, alkyl, alkenyl, aryl, substituted alkyl, substituted alkenyl or substituted aryl, with the proviso that any two R5 groups can be alkylene or substituted alkylene whereby a ring of up to about 12 carbon atoms is formed; M is one equivalent of a metal cation (or a Group I or II metal cation, e.g., sodium, potassium, barium, or calcium cation); X is halogen (e.g., chloro, bromo, or iodo); Y is oxygen or divalent sulfur; Ar is an aryl or substituted aryl group of up to about 12 carbon atoms. Any two of R1, R2, R3 and R4 may also together form an alkylene or substituted alkylene group; i.e., the olefinic compound may be alicyclic.

The olefinic compound is usually one in which each R group that is not hydrogen is independently alkyl, alkenyl or aryl group. Monoolefinic and diolefinic compounds, particularly the former, are useful, and especially terminal monoolefinic hydrocarbons; that is, those compounds in which R3 and R4 are hydrogen and R1 and R2 are a hydrocarbyl group having from 1 to about 30, or from 1 to about 16, or from 1 to about 8, or from 1 to about 4 carbon atoms. Olefinic compounds having about 3 to about 30 and especially about 3 to about 16 (most often less than about 9) carbon atoms are particularly desirable. In one embodiment, the organic polysulfide comprises a sulfurized olefin, such as those described herein for the polyalkene.

The organic polysulfides may be prepared by the sulfochlorination of olefins containing four or more carbon atoms and further treatment with inorganic higher polysulfides according to U.S. Pat. No. 2,708,199, incorporated by reference for that disclosure.

In another embodiment, sulfurized olefins are produced by (1) reacting sulfur monochloride with a stoichiometric excess of a low carbon atom olefin, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, incorporated by reference for its discussion of this procedure for preparing sulfurized olefins and the sulfurized olefins thus produced.

In another embodiment, the sulfurized olefins may be prepared by the reaction, under superatmospheric pressure, of olefinic compounds with a mixture of sulfur and hydrogen sulfide in the presence of a catalyst, followed by removal of low boiling materials. This procedure for preparing sulfurized compositions that are useful in the present invention is described in U.S. Pat. Nos. 4,119,549, 4,119,550, 4,191,659, and 4,344,854, incorporated by reference for their description of the preparation of useful sulfurized compositions.

The following example relates to organic polysulfides.

EXAMPLE S-1

Sulfur (526 parts, 16.4 moles) is charged to a jacketed, high-pressure reactor that is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid.

The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

EXAMPLE S-2

Sulfur monochloride (2025 grams, 15.0 moles) is heated to 45° C. Through a sub-surface gas sparge, 1468 grams (26.2 moles) of isobutylene gas are fed into the reactor over a 5-hour period. The temperature is maintained between 45–50° C. At the end of the sparging, the reaction mixture increases in weight of 1352 grams. In a separate reaction vessel are added 2150 grams (16.5 moles) of 60% flake sodium sulfide, 240 grams (7.5 moles) sulfur, and a solution of 420 ml. of isopropanol in 4000 ml. of water. The contents are heated to 40° C. The adduct of the sulfur monochloride and isobutylene previously prepared is added over a three-quarter hour period while permitting the temperature to rise to 75° C. The reaction mixture is heated to reflux for 6 hours, and afterward the mixture is permitted to form into separate layers. The lower aqueous layer is discarded. The upper organic layer is mixed with two liters of 10% aqueous sodium hydroxide, and the mixture is heated to reflux for 6 hours. The organic layer is again removed and washed with one liter of water. The washed product is dried by heating at 90° C. and 30 mm. Hg. pressure for 30 minutes. The residue is filtered through diatomaceous earth filter aid to give 2070 grams of a clear yellow-orange liquid.

Dispersant

As described above, the lubricating compositions contain from about 0.01% to about 5% by weight of at least one dispersant. Generally, the dispersant is present in an amount from about 0.1% to about 3%, or from about 0.2% to about 2%, or from about 0.3% to about 1.5% by weight of the lubricating composition. In one embodiment, the lubricating composition is an automotive gear oil. In this embodiment, the sulfur containing phosphoric acid ester is present in an amount from about 0.1% to about 1.5%, or from about 0.2% to about 1%, or from about 0.3% to about 0.8% by weight. In another embodiment, the lubricating composition is an industrial gear oil. In this embodiment, the sulfur containing phosphoric acid ester is present in an amount from about 0.001% to about 0.7%, or from about 0.05% to about 0.5%, or from about 0.7% to about 0.3% by weight.

The dispersants include acylated amines, carboxylic esters, Mannich reaction products, hydrocarbyl-substituted amines, and mixtures thereof. In one embodiment, the dispersant is a boron-containing dispersant. The acylated amines include reaction products of one or more carboxylic acylating agent and one or more amine. The carboxylic acylating agents include fatty acids, isoaliphatic acids, dimer acids, addition dicarboxylic acids, trimer acids, addition tricarboxylic acids, and hydrocarbyl substituted carboxylic acylating agents. In one embodiment, the carboxylic acylating agent is a fatty acid. The fatty acids generally contain from about 8 to about 30, or from about 12 to about 24 carbon atoms. Examples of fatty acids include palmitoleic acid, oleic, linoleic, linolenic, erucic acid, lard oil acid, soybean oil acid, tall oil and rosin acid.

In another embodiment, the carboxylic acylating agents include isoaliphatic acids. Such acids contain a principal saturated, aliphatic chain typically having from about 14 to about 20 carbon atoms and at least one, but usually no more than about four, pendant acyclic lower alkyl groups. Specific examples of such isoaliphatic acids include 10-methyl-tetradecanoic acid, 3-ethyl-hexadecanoic acid, and 8-methyl-octadecanoic acid. The isoaliphatic acids include branched-chain acids prepared by oligomerization of commercial fatty acids, such as oleic, linoleic and tall oil fatty acids.

The dimer acids include products resulting from the dimerization of unsaturated fatty acids and generally contain an average from about 18 to about 44, or from about 28 to about 40 carbon atoms. Dimer acids are described in U.S. Pat. Nos. 2,482,760, 2,482,761, 2,731,481, 2,793,219, 2,964,545, 2,978,468, 3,157,681, and 3,256,304, incorporated herein by reference.

In another embodiment, the carboxylic acylating agents are addition carboxylic acylating agents, which are addition (4+2 and 2+2) products of an unsaturated fatty acid, such as tall oil acids and oleic acids, with one or more unsaturated carboxylic reagents, which are described herein. These acids are taught in U.S. Pat. No. 2,444,328, incorporated herein by reference.

In another embodiment, the carboxylic acylating agent is a hydrocarbyl substituted carboxylic acylating agent. The hydrocarbyl-substituted carboxylic acylating agents are prepared by a reaction of one or more olefins or polyalkenes with one or more unsaturated carboxylic reagent. The unsaturated carboxylic reagents include unsaturated carboxylic acids per se and functional derivatives thereof, such as anhydrides, esters, amides, imides, salts, acyl halides, and nitrites. The unsaturated carboxylic reagent include mono, di, tri or tetracarboxylic reagents. Specific examples of useful monobasic unsaturated carboxylic acids are acrylic acid, methacrylic acid, cinnamic acid, crotonic acid, 2-phenylpropenoic acid, etc. Exemplary polybasic acids include maleic acid, maleic anhydride, fumaric acid, mesaconic acid, itaconic acid and citraconic acid. Generally, the unsaturated carboxylic reagent is maleic anhydride, acid or lower ester, e.g. those containing less than 8 carbon atoms.

The hydrocarbyl group generally contains from about 8 to about 300, or from about 12 up to about 200, or from about 16 up to about 150, or from about 30 to about 100 carbon atoms. In one embodiment, the hydrocarbyl group contains from about 8 up to about 40, or from about 10 up to about 30, or from about 12 up to about 24 carbon atoms. The hydrocarbyl group may be derived from an olefin. The olefins typically contain from about 3 to about 40, or from about 4 to about 24 carbon atoms. These olefins include alpha-olefins (sometimes referred to as mono-1-olefins or terminal olefins) or isomerized alpha-olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available alpha-olefin fractions that can be used include the C15–18 alpha-olefins, C12–16 alpha-olefins, C14–16 alpha-olefins, C14–18 alpha-olefins, C16–18 alpha-olefins, C16–20 alpha-olefins, C18–24 alpha-olefins, C22–28 alpha-olefins, etc.

In another embodiment, the hydrocarbyl group is derived from a polyalkene. The polyalkene includes homopolymers and interpolymers of polymerizable olefin monomers having from 2 up to about 16, or from 2 up to about 6, or from 2 to about 4 carbon atoms. The olefins may be monoolefins, such as ethylene, propylene, 1-butene, isobutene, and 1-octene, or polyolefinic monomers, including diolefinic monomers, such 1,3-butadiene and isoprene. In one embodiment, the interpolymer is a homopolymer. In one embodiment, the homopolymer is a polybutene, such as a polybutene in which about 50% of the polymer is derived from butylene. The polyalkenes are prepared by conventional procedures. In one embodiment, the polyalkene is characterized as containing from about 8 up to about 300, or from about 30 up to about 200, or from about 35 up to about 100 carbon atoms. In one embodiment, the polyalkene is characterized by an n (number average molecular weight) of at least about 400 or at least about 500. Generally, the polyalkene is characterized by having an n from about 500 up to about 5000, or from about 700 up to about 3000, or from about 800 up to 2500, or from about 900 up to about 2000. In another embodiment, n varies from about 500 up to about 1500, or from about 700 up to about 1300, or from about 800 up to about 1200.

The abbreviation n is the conventional symbol representing number average molecular weight. Gel permeation chromatography (GPC) is a method that provides both weight average and number average molecular weights as well as the entire molecular weight distribution of the polymers. For purpose of this invention a series of fractionated polymers of isobutene, polyisobutene, is used as the calibration standard in the GPC. The techniques for determining n and w values of polymers are.well known and are described in numerous books and articles. For example, methods for the determination of n and molecular weight distribution of polymers is described in W. W. Yan, J. J. Kirkland and D. D. Bly, "Modern Size Exclusion Liquid Chromatographs," J. Wiley & Sons, Inc., 1979.

In another embodiment, the polyalkenes have a n from about 1300 up to about 5000, or from about 1500 up to about 4500, or from about 1700 up to about 3000. The polyalkenes also generally have a w/n from about 1.5 to about 4, or from about 1.8 to about 3.6, or from about 2.5 to about 3.2. The hydrocarbyl substituted carboxylic acylating agents are described in U.S. Pat. Nos. 3,219,666 and 4,234,435, incorporated by reference.

In another embodiment, the acylating agents may be prepared by reacting one or more of the above described polyalkenes with an excess of maleic anhydride to provide substituted succinic acylating agents wherein the number of succinic groups for each equivalent weight of substituent group, i.e., polyalkenyl group, is at least 1.3. The maximum number will generally not exceed 4.5. A suitable range is from about 1.3 to 3.5 and or from about 1.4 to about 2.5 succinic groups per equivalent weight of substituent groups.

The carboxylic acylating agents are known in the art and have been described in detail, for example, in the following U.S. Pat. No. 3,215,707 (Rense); U.S. Pat. No. 3,219,666 (Norman et al); U.S. Pat. No. 3,231,587 (Rense); U.S. Pat. No. 3,912,764 (Palmer); U.S. Pat. No. 4,110,349 (Cohen); and U.S. Pat. No. 4,234,435 (Meinhardt et al); and U.K. 1,440,219. These patents are incorporated herein by reference for their disclosure of carboxylic acylating agents and methods for making the same.

The above-described carboxylic acylating agents are reacted with amines to form the acylated amines. The amines may be monoamines or polyamines. Useful amines include those amines disclosed in U.S. Pat. No. 4,234,435, at Col. 21, line 4 to Col. 27, line 50, these passages incorporated herein by reference. The amines may be any of the above-described amines.

Acylated amines and methods for preparing the same are described in U.S. Pat. Nos. 3,219,666; 4,234,435; 4,952,328; 4,938,881; 4,957,649; and 4,904,401. The disclosures of acylated nitrogen dispersants and other dispersants contained in those patents is hereby incorporated by reference.

In another embodiment, the dispersant may also be a carboxylic ester. The carboxylic ester is prepared by reacting at least one or more of the above carboxylic acylating agents, such as a hydrocarbyl-substituted carboxylic acylating agent, with at least one organic hydroxy compound and optionally an amine. In another embodiment, the carboxylic ester dispersant is prepared by reacting the acylating agent with at least one of the above-described hydroxyamines.

The organic hydroxy compound includes compounds of the general formula R"(OH)m wherein R" is a monovalent or polyvalent organic group joined to the —OH groups through a carbon bond, and m is an integer from 1 to about 10 wherein the hydrocarbyl group contains at least about 8 aliphatic carbon atoms. The hydroxy compounds may be aliphatic compounds, such as monohydric and polyhydric alcohols, or aromatic compounds, such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived generally contain up to about 40 carbon atoms, or from 2 to about 30, or from 2 to about 10. They may be monohydric alcohols, such as methanol, ethanol, isooctanol, dodecanol, cyclohexanol, etc. The hydroxy compounds may also be polyhydric alcohols, such as alkylene polyols. In one embodiment, the polyhydric alcohols contain from 2 to about 40 carbon atoms, from 2 to about 20; and from 2 to about 10 hydroxyl groups, or from 2 to about 6. Polyhydric alcohols include ethylene glycols, including di-, tri- and tetraethylene glycols; propylene glycols, including di-, tri- and tetrapropylene glycols; glycerol; butanediol; hexanediol; sorbitol; arabitol; mannitol; trimethylolpropane; sucrose; fructose; glucose; cyclohexanediol; erythritol; and pentaerythritols, including di- and tripentaerythritol.

The polyhydric alcohols may be esterified with monocarboxylic acids having from 2 to about 30 carbon atoms, or from about 8 to about 18, provided that at least one hydroxyl group remains unesterified. Examples of monocarboxylic acids include acetic, propionic, butyric and above described fatty acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be prepared by any of several known methods. One examplary method involves the reaction of the carboxylic acylating agents described above with one or more alcohol or phenol in ratios from about 0.5 equivalent to about 4 equivalents of hydroxy compound per equivalent of acylating agent. The esterification is usually carried out at temperatures above about 100° C., or between 150° C. and 300° C. The water formed as a by-product is removed by distillation as the esterification proceeds. The preparation of useful carboxylic ester dispersant is described in U.S. Pat. Nos. 3,522,179 and 4,234,435, and incorporated by reference.

The carboxylic ester dispersants may be further reacted with at least one of the above-described amines. The amines include at least one of the above-described polyamines, such as a polyethylenepolyamine or a heterocyclic amine, such as aminopropylmopholine. The amine is added in an amount sufficient to neutralize any nonesterified carboxyl groups. In one embodiment, the carboxylic ester dispersants are prepared by reacting from about 1 to about 2 equivalents, or from about 1.0 to 1.8 equivalents of hydroxy compounds, and up to about 0.3 equivalent, or from about 0.02 to about 0.25 equivalent of polyamine per equivalent of acylating agent. The carboxylic acid acylating agent may be reacted simultaneously with both the hydroxy compound and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester dispersant compositions are known in the art, and the preparation of a number of these derivatives is described in, for example, U.S. Pat. Nos. 3,957,854 and 4,234,435, incorporated by reference previously.

In another embodiment, the dispersant may also be a hydrocarbyl-substituted amine. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289, incorporated by reference for their disclosure of hydrocarbyl amines and methods of making the same. Typically, hydrocarbyl-substituted amines are prepared by reacting olefins and olefin polymers, including the above polyalkenes and halogenated derivatives thereof, with amines (mono- or polyamines). The amines may be any of the amines described above, such as an alkylenepolyamine. Examples of hydrocarbyl-substituted amines include poly(propylene) amine; N,N-dimethyl-N-poly(ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene) ethylenediamine; N-poly(propylene)trimethylenediamine; N-poly(butene)diethylenetriamine; N',N'-poly(butene) tetraethylenepentamine; N,N-dimethyl-N'-poly(propylene)-1,3-propylenediamine and the like.

In another embodiment, the dispersant may also be a Mannich dispersant. Mannich dispersants are generally formed by the reaction of at least one of the above described aldehydes, such as formaldehyde and paraformaldehyde, at least one of the above-described amines and at least one alkyl-substituted hydroxyaromatic compound. The reaction may occur from room temperature to about 225° C., or from about 50° to about 200° C., or from about 75° C. to about 150° C. The amounts of the reagents is such that the molar ratio of hydroxyaromatic compound to formaldehyde to amine is in the range from about (1:1:1) to about (1:3:3).

The first reagent is an alkyl-substituted hydroxyaromatic compound. This term includes the above-described phenols, although the phenol need not be hindered. The hydroxyaromatic compounds are those substituted with at least one, and generally not more than two, aliphatic or alicyclic groups having from about 6 up to about 400, or from about 30 up to about 300, or from about 50 up to about 200 carbon atoms. These groups may be derived from one or more of the above described olefins or polyalkenes. In one embodiment, the hydroxyaromatic compound is a phenol-substituted with an aliphatic or alicyclic hydrocarbon-based group having an n of about 420 to about 10,000.

The third reagent is any amine described above. In one embodiment, the amine is one or more of the above-described polyamines, such as the polyalkylenepolyamines. Mannich dispersants are described in U.S. Pat. Nos. 3,980,569; 3,877,899; and 4,454,059, incorporated by reference for their disclosure to Mannich dispersants.

In another embodiment, the dispersant is a borated dispersant. The borated dispersants are prepared by reacting one or more of the above disperants with at least one boron compound. The boron compounds include boron oxide, boron oxide hydrate, boron trioxide, boron acids, such as boronic acid (i.e., alkyl-B(OH)2 or aryl-B(OH)2), including methyl boronic acid, phenyl-boronic acid, cyclohexyl boronic acid, p-heptylphenyl boronic acid and dodecyl boronic acid, boric acid (i.e., H3BO3), tetraboric acid (i.e., H2B4O7), metaboric acid (i.e., HBO2), boron anhydrides, boron amides and various esters of such boron acids.

In one embodiment, the boron compounds include mono-, di-, and tri-organic esters of boric acid and alcohols or phenols. Examples of the alcohols include methanol, ethanol, propanol, butanol, 1-octanol, benzyl alcohol, ethylene glycol, glycerol, and Cellosolve. Lower alcohols, having less than about 8 carbon atoms, and glycols, such as 1,2-glycols and 1,3-glycols, are especially useful. Methods for preparing the esters are known and disclosed in the art (such as "Chemical Reviews," pp. 959–1064, Vol. 56).

Typically, the borated dispersant contains from about 0.1% up to about 5%, or from about 0.5% up to about 4%, or from 0.7% up to about 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662 and 4,925,983, incorporated by reference for their disclosure of borated dispersants.

The following examples relate to dispersants useful in the present invention.

EXAMPLE D-1

(a) An acylated nitrogen composition is prepared by reacting 3880 grams of the polyisobutenyl succinic anhydride, 376 grams of a mixture of triethylenetetramine and diethylene triamine (75:25 weight ratio), and 2785 grams of mineral oil in toluene at 150° C. The product is vacuum stripped to remove toluene.

(b) A mixture of 62 grams (I atomic proportion of boron) of boric acid and 1645 grams (2.35 atomic proportions of nitrogen) of the acylated nitrogen composition obtained from D-1 (a) is heated at 150° C. in nitrogen atmosphere for 6 hours. The mixture is then filtered and the filtrate is found to have a nitrogen content of 1.94% and a boron content of 0.33%.

EXAMPLE D-2

A mixture of 372 grams (6 atomic proportions of boron) of boric acid and 311 grams (6 atomic proportions of nitrogen) of a acylated nitrogen composition, obtained by reacting 1 equivalent of a polybutenyl (n=850) succinic anhydride, having an acid number of 113 (corresponding to an equivalent weight of 500), with 2 equivalents of a commercial ethylene amine mixture having an average composition corresponding to that of tetraethylenepentamine, is heated at 150° C. for 3 hours and then filtered. The filtrate is found to have a boron content of 1.64% and a nitrogen content of 2.56%.

EXAMPLE D-3

Boric acid (124 grams, 2 atomic proportions of boron) is added to the acylated nitrogen composition (556 grams, 1 atomic proportion of nitrogen) of Example D-2. The resulting mixture is heated at 150° C. for 3.5 hours and filtered at that temperature. The filtrate is found to have a boron compound of 3.23% and a nitrogen content of 2.3%.

EXAMPLE D-4

(a) A reaction vessel is charged with 1000 parts of a polybutenyl (n=1000 substituted succinic anhydride having a total acid number of 108 with a mixture of 275 grams of oil and 139 parts of a commercial mixture of polyamines corresponding to 85% E-100 amine bottoms and 15% diethylenetriamine. The reaction mixture is heated to 150 to 160° C. and held for four hours. The reaction is blown with nitrogen to remove water.

(b) A reaction vessel is charged with 1405 parts of the product of Example D-4(a), 229 parts of boric acid, and 398 parts of diluent oil. The mixture is heated to 100 to 150° C. and the temperature maintained until water is removed. The final product contains 2.3% nitrogen, 1.9% boron, 33% 100 neutral mineral oil and a total base number of 60.

Metal Deactivators

In one embodiment, the lubricating compositions includes at least one triazole metal deactivator. In this embodiment, the triazole metal deactivator is present in the lubricating composition in an amount sufficient to provide a metal deactivating effect. Generally, The metal deactivator is present in the inventive lubricating composition at a level of up to about 20% by weight, or up to about 10% by weight, based on the total weight of the lubricant. Typically, the metal deactivator is present at a level of about 0.001%, or about 0.005%, or about 0.008% by weight up to about 2%, or about 1%, or about 0.5% by weight based on the weight of the lubricating composition. In one embodiment, the lubricating composition is an automotive gear oil. In this embodiment, the metal deactivator is present in an amount from about 0.001% to about 0.5%, or from about 0.005% to about 0.3%, or from 0.01% to about 0.1% by weight. In another embodiment, the lubricating composition is an industrial gear oil. In this embodiment, the metal deactivator is present in an amount from about 0.001% to about 0.5%, or from about 0.005% to about 0.3%, or from 0.01% to about 0.1% by weight.

The triazole metal deactivators that are useful herein reduce the corrosion of metals, such as copper. Triazole metal deactivators are also referred to as metal passivators. In one embodiment, the triazole metal deactivator comprises at least one substituted or unsubstituted triazole. Examples of suitable compounds are benzotriazole, alkyl-substituted benzotriazole (e.g., tolyltriazole, ethylbenzotriazole, hexylbenzotriazole, octylbenzotriazole, etc.), aryl-substituted benzotriazole (e.g., phenol benzotriazoles, etc.), and alkylaryl- or arylalkyl-substituted benzotriazole and substituted benzotriazoles where the substituent may be hydroxy, alkoxy, halo (especially chloro), nitro, carboxy and carboxyalkoxy. In one embodiment, the triazole is a benzotriazole or an alkylbenzotriazole in which the alkyl group contains 1 to about 20, or from 1 to about 12, or from 1 to about 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly useful.

The metal deactivator may also be the reaction product of a triazole and at least one compound selected from acylated nitrogen compounds (described herein as carboxylic dispersants), hydrocarbyl-substituted amines (described herein as amine dispersants) and Mannich reaction products (described herein as Mannich dispersants).

The amines that are useful are described above as being reactive with benzotriazole to form metal deactivators. Typically the amines are polyamines, which include ethylene amines, amine bottoms or amine condensates.

The hydrocarbyl-substituted amines, which may be reacted with a triazole, are well known to those skilled in the art. These amines are disclosed in U.S. Pat. Nos. 3,275,554; 3,438,757; 3,454,555; 3,565,804; 3,755,433; and 3,822,289.

The triazole-amine, triazole-acylated amine, triazole-hydrocarbyl substituted amine and triazole-Mannich reaction products may be prepared by blending the reagents and allowing the reaction to proceed. The reaction may occur at a temperature in the range of about 15° C. to about 160° C., or of about 60° C. to about 1 40° C. The triazole-amine, triazole-acylated nitrogen compound, triazole-hydrocarbyl-substituted amine and triazole-Mannich reaction products may be reacted in any proportion but in one embodiment are reacted at an equal equivalent ratio.

Thiadiazole Derivative

In another embodiment, the lubricating composition contains a thiadiazole derivative. The thiadizaole derivative is present in an amount to provide protection to copper. It acts as a metal deactivator and a copper passivator. Typically, the thiadiazole derivative is present at a level of about 0.001%, or about 0.005%, or about 0.008% by weight up to about 5%, or about 2%, or about 1%, or about 0.5% by weight based on the weight of the lubricating composition. In one embodiment, the lubricating composition is an automotive gear oil. In this embodiment, the thiadiazole derivative is present in an amount from about 0.001% to about 1.0%, or from about 0.001% to about 0.5%, or from about 0.005% to about 0.3%, or from 0.01% to about 0.1% by weight. In another embodiment, the lubricating composition is an industrial gear oil. In this embodiment, the thiadiazole derivative is present in an amount from about 0.001% to about 1.0%, or from about 0.001% to about 0.5%, or from about 0.005% to about 0.3%, or from 0.01% to about 0.1% by weight.

The thiadiazole derivatives include a) mono- or di-substituted hydrocarbylthio or hydrocarbyldithio-substituted thiadiazoles; b) carboxylic esters of DMTD; c) condensation products of halogenated aliphatic monocarboxylic acids with DMTD; d) reaction products of unsaturated cyclic hydrocarbons and unsaturated ketones with DMTD; e) reaction products of an aldehyde and diaryl amine with DMTD; f) amine salts of DMTD; g) Dithiocarbamate derivatives of DMTD; h) reaction products of an aldehyde, and an alcohol or aromatic hydroxy compound, and DMTD; i) reaction products of an aldehyde, a mercaptan and DMTD; j) products from combining an oil soluble dispersant with DMTD; and k) mixtures of two or more thereof.

Compositions a–j are described in U.S. Pat. No. 4,612,129 and patent references cited therein. This patent is hereby incorporated by reference.

In one embodiment, the thiadiazole derivatives include mono- or di-substituted thiadiazoles having a hydrocarbylthio group, a hydrocarbyldithio group, or mixture of these groups. Examples of these thiadiazoles include hydrocarbylthio, mercaptothiadiazole; bis-(hydrocarbylthio) thiadiazole; hydrocarbyidithio, mercaptothiadiazole; and bis-(hydrocarbyidithio) thiadiazole. It is understood that the hydrocarbyl groups on the thiadiazole may be the same or different. The hydrocarbyl groups may be aliphatic or aromatic, including alkyl, cyclic, alicyclic, aralkyl, aryl and alkaryl. In one embodiment, the hydrocarby! groups independently contain from 1 to about 30, or from about 2 to about 24, or from about 4 to about 12 carbon atoms. Here and elsewhere in the specification and claims, the range or ratio limits may be combined. Examples of specific hydrocarbyl groups may be an alkyl group such as methyl, ethyl, propyl, butyl, hexyl, heptyl, octyl, nonyl, decyl or dodecyl groups undecyl, dodecyl, cetyl groups, and isomers thereof.

The 1,3,4-thiadiazole compounds, or mixtures thereof, contemplated for use in the present invention can be readily obtained from commercial sources, such as the Amoco Petroleum Additives Company, or can be synthesized from hydrazine and carbon disulfide in a well-known manner. Particularly useful thiadiazoles include compositions commercially available from the Amoco Petroleum Additives Company under the trade names "Amoco-153" and "Amoco-158." A 2,5-bis-(hydrocarbyldithio)-1,3,4-thiadiazole and its mono-substituted equivalent 2-hydrocarbylthio-5-mercapto-1,3,4-thiadiazole are commercially available as a mixture of the two compounds in a ratio of about 85% bis-hydrocarbyl to 15% monohydrocarbyl from the Ethyl Corporation as Hitec 4313.

U.S. Pat. Nos. 2,719,125; 2,719,126; 2,765,289; 2,749,311; 2,760,933; 2,850,453; 2,910,439; 3,087,937; 3,663,561; 3,862,798; and 3,840,549 may be referred to for detailed procedures on the preparation of the 1,3,4-thiadiazole compounds contemplated for use in lubricating compositions of the present invention. These patents are incorporated by reference herein.

A process for preparing such derivatives is described in U.S. Pat. No. 2,191,125 as comprising the reaction of DMTD with a suitable sulfenyl chloride or by reacting the dimercapto diathiazole with chlorine and reacting the resulting disulfenyl chloride with a primary or tertiary mercaptan. Suitable sulfenyl chlorides useful in the first procedure can be obtained by chlorinating a mercaptan (RSH or R1 SH) with chlorine in carbon tetrachloride. In a second procedure, DMTD is chlorinated to form the desired bissulfenyl chloride which is then reacted with at least one mercaptan (RSH and/or R1 SH). The disclosures of U.S. Pat. Nos. 2,719,125; 2,719,126; and 3,087,937 are incorporated by reference for their description of derivatives of DMTD useful in the compositions of the invention. U.S. Pat. No. 3,087,932 describes a one-step process for preparing 2,5-bis (hydrocarbyldithio)-1,3,4-thiadiazole. The procedure involves the reaction of either DMTD or its alkali metal or ammonium salt and a mercaptan in the presence of hydrogen peroxide and a solvent.

Oil-soluble or oil-dispersible reaction products of DMTD can be prepared also by the reaction of the DMTD with a mercaptan and formic acid. Compositions prepared in this manner are described in U.S. Pat. No. 2,749,311. Any mercaptan can be employed in the reaction, such as aliphatic and aromatic mono- or poly-mercaptan containing from 1 to about 30, or from. about 2 to about 18, carbon atoms. The disclosures of U.S. Pat. Nos. 3,087,932 and 2,749,311 are incorporated by reference for their description of DMTD derivatives that can be utilized as components of the composition of this invention. It will be understood by those skilled in the art that the reactions outlined above produce some amounts of the monohydrocarbyidithio-thiadiazole as well as the bis-hydrocarbyl compounds. The ratio of the two can be adjusted by varying the amounts of the reactants.

The preparation of 2-hydrocarbyldithio-5-mercapto-1,3,4-thiadiazoles is described in U.S. Pat. No. 3,663,561, incorporated by reference. The compositions are prepared by the oxidative coupling of equimolecular portions of a hydrocarbyl mercaptan and DMTD or its alkali metal mercaptide. The mono-mercaptans used in the preparation of the compounds are represented by the formula R1 SH, wherein R1 is a hydrocarbyl group containing from 1 to about 28 carbon atoms. A peroxy compound, hypohalide or air, or mixtures thereof can be utilized to promote the oxidative coupling. Specific examples of the mono-mercaptan include methyl mercaptan, isopropyl mercaptan, hexyl mercaptan, decyl mercaptan, and long chain alkyl mercaptans, for example, mercaptans derived from the polyalkenes described herein, such as propene polymers and isobutylene polymers especially polyisobutylenes, having 3 to about 70 propene or isobutylene units per molecule. The disclosure of U.S. Pat. No. 3,663,561 is incorporated by reference for its identification of DMTD derivatives which are useful as components in the compositions of this invention.

Carboxylic esters of DMTD (b) are described in U.S. Pat. No. 2,760,933. These esters are prepared by reacting DMTD with an organic acid halide (chloride) and a molar ratio of 1:2 at a temperature of from about 25 to about 130E C. Suitable solvents, such as benzene or dioxane, can be utilized to facilitate the reaction. The reaction product is washed with dilute aqueous alkali to remove hydrogen chloride and any unreacted carboxylic acid. The disclosure of U.S. Pat. No. 2,760,933 is incorporated by reference for its description of various DMTD derivatives that can be utilized in-the compositions of the present invention.

Condensation products of alpha-halogenated aliphatic monocarboxylic acids with DMTD (c) are described in U.S. Pat. No. 2,836,564. Examples of alpha-halogenated aliphatic fatty acids that can be used include alpha-bromo or alpha-chloro carboxylic acids containing form about 6 to about 30, or from about 8 to about 24 carbon atoms. Specific examples include alpha-bromo-lauric acid, alpha-chloro-lauric acid, alpha-chloro-stearic acid, etc. The disclosure of U.S. Pat. No. 2,836,564 is incorporated by reference for its disclosure of derivatives of DMTD that can be utilized in the compositions of the present invention.

Oil-soluble reaction products of unsaturated cyclic hydrocarbons and unsaturated ketones (d) are described in U.S. Pat. Nos. 2,764,547 and 2,799,652, incorporated by reference for their description of materials. Examples of unsaturated cyclic hydrocarbons described in the '547 patent include styrene, alpha-methyl styrene, pinene, dipentene, cyclopentadiene, etc. The unsaturated ketones, described in U.S. Pat. No. 2,799,652, include aliphatic, aromatic or heterocyclic unsaturated ketones containing from about 4 to about 40 carbon atoms and from 1 to 6 double bonds. Examples include mesityl oxide, phorone, isophorone, benzal acetophenone, furfural acetone, difurfuryl acetone, etc.

U.S. Pat. No. 2,850,453 describes products that are obtained by reacting DMTD, an aldehyde and an alcohol or an aromatic hydroxy compound (e) in a molar ratio of from 1:2:1 to 1:6:5. The aldehyde employed can be an aliphatic aldehyde containing from 1 to about 20 carbon atoms or an aromatic or heterocyclic aldehyde containing from about 5 to about 30 carbon atoms. Examples of suitable aldehydes include formaldehyde, acetaldehyde, benzaldehyde, etc. The reaction can be conducted in the presence or absence of suitable solvents by (a) mixing all of the reactants together and heating, (b) by first reacting an aldehyde with the alcohol or the aromatic hydroxy compound, and then reacting the resultant intermediate with the thiadiazole, or (c) by reacting the aldehyde with thiadiazole first and the resulting intermediate with the hydroxy compound. The disclosure of U.S. Pat. No. 2,850,453 is incorporated by reference.

U.S. Pat. No. 2,703,784 describes products obtained by reacting DMTD with an aldehyde and a mercaptan (f). The aldehydes are similar to those disclosed in U.S. Pat. No. 2,850,453. The disclosure of this patent also is incorporated by reference. The mercaptans may be one or more of those described herein. In one embodiment, the mercaptans are aliphatic or aromatic mono- or poly-mercaptans containing from about 1 to about 30, or from about 2 to about 24 carbon atoms. Examples of suitable mercaptans include ethyl mercaptan, butyl mercaptan, octyl mercaptan, etc.

U.S. Pat. No. 3,663,561 describes thiadiazole derivatives that are prepared by the oxidative coupling of equomolecular portions of a hydrocarbyl mercaptan and DMTD or its alkali metal mercaptide. The mono-mercaptans used in the preparation of the compounds include those described herein and may be represented by the formula R'SH, wherein R' is a hydrocarbyl group containing from 1 to about 280 carbon atoms. A peroxy compound (such as the peroxides described herein) hypohalide or air, or mixtures thereof can be utilized to promote the oxidative coupling. Specific examples of the mono-mercaptan include methyl mercaptan, isopropyl mercaptan, hexyl mercaptan, decyl mercaptan, and long chain alkyl mercaptans, for example, mercaptans derived from propene polymers and isobutylene polymers especially polyisobutylenes, having 3 to about 70 propene or isobutylene units per molecule. The disclosure of U.S. Pat. No. 3,663,561 is incorporated by reference.

In one embodiment, the metal deactivator is the reaction product of a dispersant with a dimercaptothiadiazole. The dispersants may be generally characterized as the reaction products of carboxylic acids with amines and/or alcohols. These reaction products are commonly used in the lubricant arts as dispersants and are sometimes referred to generically as dispersants despite the fact that they may have other uses in addition to or instead of that as dispersants. The carboxylic dispersants include succinimide dispersants, ester type dispersants and the like. Succinimide dispersants are generally the reaction of a polyamine with an alkenyl succinic anhydride or acid. Ester type dispersants are the reaction product of an alkenyl succinic anhydride or acid with a polyol compound. The reaction product may then be further treated with an amine such as a polyamine. Examples of useful dispersants are disclosed in U.S. Pat. Nos. 3,219,666 and 4,234,435.

Useful dispersants also include the ashless dispersants discussed below under the heading "Detergents and Dispersants." Generally the reaction occurs between the dispersant and the dimercaptothiadiazole by mixing the two and heating to a temperature above about 100° C. U.S. Pat. Nos. 4,140,643 and 4,136,043 describe compounds made by the reaction of such dispersants with a dimercaptothiadiazole.

In one embodiment, the metal deactivator is the reaction product of a phenol with an aldehyde and a dimercaptothiadiazole. In one embodiment, the phenol is an alkyl phenol wherein the alkyl group contains at least about 6, or from 6 to about 24, or about 6, or about 7, to about 12 carbon atoms. In one embodiment, the aldehyde is an aldehyde containing from 1 to about 7 carbon atoms or an aldehyde synthon, such as formaldehyde. In one embodiment, the aldehyde is formaldehyde or paraformaldehyde. The aldehyde, phenol and dimercaptothiadiazole are typically reacted by mixing them at a temperature up to about 150° C., preferably about 50° C. to about 130° C., in molar ratios of about 0.5 to about 2 moles of phenol and about 0.5 to about 2 moles of aldehyde per mole of dimercaptothiadiazole. In one embodiment, the three reagents are reacted in equal molar amounts.

In one embodiment, the metal deactivator is a bis (hydrocarbyldithio)thiadiazole. In one embodiment, each hydrocarbyl group is independently an alkyl, aryl or aralkyl group, having from 6 to about 24 carbon atoms. Each hydrocarbyl can be independently t-octyl, nonyl, decyl, dodecyl or ethylhexyl. The metal deactivator can be bis-2,5-tert-octyl-dithio-1,3,4-thiadiazole or a mixture thereof with 2-tert-octyl-thio-5-mercapto-1,3,4-thiadiazole. These materials are available commercially under the trade name of Amoco 150, available from Amoco Chemical Company. These dithiothiadiazole compounds are disclosed as Component (B) in PCT Publication WO 88/03551.

The metal deactivator may also be the reaction product of a benzotriazole with at least one amine. The amine can be one or more mono or polyamines. These monoamines and polyamines can be primary amines, secondary amines or tertiary amines. Useful amines include those amines disclosed in U.S. Pat. No. 4,234,435 at Col. 21, line 4 to Col. 27, line 50.

Oil of Lubricating Viscosity

The lubricant and concentrate include an oil of lubricating viscosity. The oil of lubricating viscosity is generally present in a major amount (i.e. an amount greater than about 50% by weight). In one embodiment, the oil of lubricating viscosity is present in an amount greater than about 60%, or greater than about 70%, or greater than about 80% by weight of the composition. The oils of lubricating viscosity include natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention. A description of oils of lubricating viscosity occurs in U.S. Pat. No. 4,582,618 (column 2, line 37 through column 3, line 63, inclusive), incorporated by reference for its disclosure to oils of lubricating viscosity.

In one embodiment, the oil of lubricating viscosity is a polyalpha-olefin (PAO). Typically, the polyalpha-olefins are derived from monomers having from about 3 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt polyolefins, 6 cSt polyolefins, 40 cSt polyolefins and 100 cSt polyalphaolefins.

In one embodiment, the oil of lubricating viscosity are selected to provide lubricating compositions with a kinematic viscosity of at least about 3.5 cSt, or at least about 4.0 cSt at 100° C. In one embodiment, the lubricating compositions have an SAE gear viscosity grade of at least about SAE 75W. The lubricating composition may also have a so-called multigrade rating such as SAE 75W-80, 75W-90, 75W-90, 75W-140, 80W-90, 80W-140, 85W-90, or 85W-140.

In one embodiment, the oil of lubricating viscosity is a mineral oil. The mineral oils have an iodine number of less than 9 and/or at least about 45% of the saturates present as aliphatic saturates. Iodine value is determined according to ASTM D-460. In one embodiment, the mineral oil has an iodine value less than about 8, or less than about 6, or less than about 4. The saturates level are determined by mass spectrometer. By mass spectroscopy, Group I stocks have about 70% saturates, Group II stocks have about 95% to about 98% saturates and Group III stocks have about 98%–100% saturates. Group II stocks have greater than 50% of their saturates present as cycloparaffinic compounds. The saturates of the mineral oils used in the present invention typically have at least about 45%, or at least about 50%, or at least about 60% aliphatic saturates. These aliphatic saturates are often referred to as paraffinic saturates. The cyclic saturates are generally referred to as cycloparaffinic saturates. Cyclic saturates compose the balance of the saturates in the mineral oils. The inventors have discovered that mineral oils having a higher proportion of aliphatic saturates have better oxidation properties and low temperature properties.

As use herein the term "mineral oil" refers to oils of lubricating viscosity that are derived from petroleum crude. The petroleum crudes may be subjected to processing such as hydroprocessing, hydrocracking, and isomerizing. Hydroprocessing includes processes such as sequential isocracking, isodewaxing and hydrofinishing. These mineral oils are those referred to as Group III basestock or base oils. In one embodiment, the mineral oil has less than 0.3% or less than 0.1% sulfur. In another embodiment, the oils of lubricating viscosity generally have a viscosity index of 120 or more.

Examples of useful oils of lubricating viscosity include HVI and XHVI basestocks, such isomerized wax base oils and UCBO (Unconventional Base Oils) base oils. Specific examples of these base oils include 10ON isomerized wax basestock (0.01% sulfur/141 VI), 120N isomerized wax basestock (0.01% sulfur/149 VI), 170N isomerized wax basestock (0.01% sulfur/142 VI), and 250N isomerized wax basestock (0.01% sulfur/146 VI); refined basestocks, such as 250N solvent-refined paraffinic mineral oil (0.16% sulfur/89 VI), 200N solvent refined naphthenic mineral oil (0.2% sulfur/60 VI), 100N solvent refined/hydrotreated paraffinic mineral oil (0.01% sulfur/98 VI), 240N solvent refined/hydrotreated paraffinic mineral oil (0.01% sulfur/98 VI), 80N solvent refined/hydrotreated paraffinic mineral oil (0.08% sulfur/127 VI), and 150N solvent refined/hydrotreated paraffinic mineral oil (0.17% sulfur/127 VI). Further examples of the mineral oils include those Group III basestocks made by Texaco such as the TEXHVI stocks which include TEXHVI-100N (95% saturates, 125 viscosity index and 0.02% sulfur); TEXHVI-70N (97.8% saturates, 123 viscosity index and 0.02% sulfur); Texaco "MOTIVA" TEXHVI 90N-100N (100% saturates, 125 viscosity index and 0.01% sulfur); and "MOTIVA" TEXHVI 75N (100% saturates, 125 viscosity index and 0.0% sulfur). Examples of useful Group III basestocks made by Chevron include UCBO 200N (100% saturates, 142 viscosity index and 0.005% sulfur); UCBO 100N (100% saturates, 129 viscosity index, and 0.004% sulfur).

Polymers

In one embodiment, the multigrade lubricant will have at least one polymer present. The polymer generally is present in an amount from about 3% to about 40%, or from about 5% to about 35%, or from about 10% to about 30% by weight of the lubricating composition. The polymers include a polyalkene or derivative thereof, an ethylene-olefin copolymer, an ethylene-propylene polymer, an olefin-unsaturated carboxylic reagent copolymer, a polyacrylate, a polymethacrylate, a hydrogenated interpolymer of an alkenylarene and a conjugated diene, and mixtures thereof. Here, and elsewhere within the specification and claims, any member of a genus (or list) may be excluded from the claims.

In one embodiment, the polymer is characterized by an Mw (weight average molecular weight) of less than about 50,000, or less than about 45,000, or less than about 40,000. In one embodiment, the polymer has an Mw of less than about 25,000, or less than about 10,000, or less than about 7,000. Typically the polymer has an Mw of at least about 1,000, or at least about 2,000, or at least about 3,000. In one embodiment, the polymer is characterized by an Mn (number average molecular weight) of up to about 6000, or up to about 5000. Generally, the polymer is characterized by having an Mn from about 800 to about 6000, or from about 900 to about 5000, or from about 1000 to 4000. In another embodiment, the polymers have a Mn from about 1300 to about 5000, or from about 1500 to about 4500, or from about 1700 to about 3000. The polymers also generally have a Mw/Mn from about 1.5 to about 8, or from about 1.8 to about 6.5, or from about 2 to about 5.5.

In one embodiment, the polymer may be a sheared polymer of higher molecular weight, e.g. greater than 50,000. In this embodiment, a higher molecular weight polymer is sheared to the desired molecular weight. The shearing may be done in any suitable apparatus, such as an extruder, an injector, an FZG apparatus, etc.

The abbreviation Mw and Mn is the conventional symbol representing weight average and number average molecular weight, respectively. Gel permeation chromatography (GPC) is a method that provides both molecular weights as well as the entire molecular weight distribution of the polymers. For purpose of this invention a series of fractionated polymers of isobutene, polyisobutene, is used as the calibration standard in the GPC. The techniques for determining n and w values of polymers are well known and are described in numerous books and articles. For example, methods for the determination of n and molecular weight distribution of polymers is described in W. W. Yan, J. J. Kirkland and D. D. Bly, "Modern Size Exclusion Liquid Chromatographs," J. Wiley & Sons, Inc., 1979.

In one embodiment, the polymer is one of the polyalkenes described herein. In another embodiment, the polymer is a derivative of a polyalkene. The derivatives are typically prepared by reacting one or more of the above polyalkenes or a halogenated derivative thereof with an unsaturated reagent. The halogenated polyalkenes are prepared by reacting a polyalkene with a halogen gas, such as chlorine. The preparation of these materials is known to those in the art. The unsaturated reagents include unsaturated amines, ethers, and unsaturated carboxylic reagents, such as unsaturated acids, esters, and anhydrides. Examples of unsaturated amines include unsaturated amides, unsaturated imides, and nitrogen containing acrylate and methacrylate esters. Specific examples of unsaturated amines include acrylamide, N,NN-methylene bis(acrylamide), methacrylamide, crotonamide, N-(3,6-diazaheptyl) maleimide, N-(3-dimethylaminopropyl) maleimide, N-(2-methoxyethoxyethyl) maleimide, N-vinyl pyrrolidinone, 2- or 4-vinyl pyridine, dimethylaminoethyl methacrylate and the like.

In one embodiment, the unsaturated carboxylic reagent is an acid, anhydride, ester, or mixtures thereof. If an ester is desired, it can be prepared by reacting an unsaturated carboxylic acid or anhydride with a polyalkene or halogenated derivative thereof and subsequently reacting the reaction product with an alcohol to form the ester. The unsaturated carboxylic reagents include acrylic acid, methacrylic acid, cinnamic acid, crotonic acid, 2-phenylpropenoic acid, maleic acid, maleic anhydride, fumaric acid, mesaconic acid, itaconic acid and citraconic acid maleic, fumaric, acrylic, methacrylic, itaconic, and citraconic acids, esters, and anhydrides (where possible). The esters may be represented by one of the formulae: (R1)2C═C(R1)C(O)OR2, or R2O—(O)C—HC═CH—C(O)OR2, wherein each R1 and R2 are independently hydrogen or a hydrocarbyl group having 1 to about 30, or to about 12, or to about 8 carbon atoms, R1 is hydrogen or an alkyl group having from 1 to about 6 carbon atoms. In one embodiment, R1 is hydrogen or a methyl group. In another embodiment, R2 is an alkyl or hydroxyalkyl group having from about 1 to about 30, or from 2 to about 24, or from about 3 to about 18 carbon atoms. R2 may be derived from one or more alcohols described below. Unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2–2-hydroxypropyl acrylate, ethyl maleate, butyl maleate and 2-ethylhexyl maleate. The above list includes mono- as well as diesters of maleic, fumaric, and itaconic acids and anhydrides.

The polyalkene derivatives are prepared by means known to those in the art. These materials have been referred to as hydrocarbyl-substituted carboxylic acylating agents, and are discussed below. U.S. Pat. Nos. 3,219,666 and 4,234,435 describe the polyalkene derivatives and methods of making the same and are incorporated for such descriptions.

In another embodiment, the polymer is an ethylene-olefin copolymer. Typically, the copolymer is a random copolymer. The copolymer generally has from about 30% to about 80%, or from about 50% to about 75% by mole of ethylene. The olefins include butene, pentene, hexene or one more of the described above described olefins. In one embodiment, the olefin contains from about 3 to about 20, or from about 4 to about 12 carbon atoms. In one embodiment, the ethylene-olefin copolymers have an Mw from about 10,000 up to about 40,000, or from about 15,000 up to about 35,000, or from about 20,000 up to about 30,000. In another embodiment, the ethylene-olefin copolymers have an n from about 800 to about 6000, or from about 1500 to about 5000, or from about 2000 to about 4500. Examples of ethylene olefins copolymers include ethylene-butene copolymers and ethylene-octene copolymers. Examples of commercially available copolymers include Lucant HC 600 and Lucant HC 2000 (Mw=25,000), available from Mitsui Petrochemical Co., Ltd.

In another embodiment, the polymer is an ethylene propylene polymer. These polymers include ethylene propylene copolymers and ethylene propylene terpolymers. When the ethylene propylene polymer is an ethylene propylene copolymer (EPM, also called EPR polymers), it may be formed by copolymerization of ethylene and propylene under known conditions, such as Ziegler-Natta reaction conditions. In one embodiment, ethylene propylene copolymers contain units derived from ethylene in an amount from about 40% to about 70%, or from about 50% to about 60%, or about 55% by mole, the remainder being derived from propylene. The molecular weight distribution may be characterized by a polydispersity (Mw/Mn) from about 1 to about 8, or from about 1.2 to about 4.

In another embodiment, the ethylene propylene polymer is a terpolymer of ethylene, propylene and a diene monomer. In one embodiment, the diene is a conjugated diene. The dienes are disclosed herein. In one embodiment, the ethylene propylene polymer is a terpolymer of ethylene, propylene and dicyclopentadiene or ethylidene norbornene, available commercially as Trilene elastomers from the Uniroyal Corporation. A useful ethylene propylene terpolymer is Trilene CP-40. The ethylene propylene polymers are prepared by means known to those in the art. U.S. Pat. No. 3,691,078 describes ethylene propylene polymers and methods of preparing them, and is incorporated by reference for such disclosures.

In another embodiment, the polymer is a copolymer of an olefin and an unsaturated reagent. The olefins may be any of those discussed above, and include propylene, 1-butene, 2-methyl propene, 2-methyl-1-octene, and 1-decene. The unsaturated reagents are described above. The unsaturated carboxylic reagents include acrylates, methacrylates, maleates and fumarates. The olefin-unsaturated carboxylic reagent polymers are prepared by means known to those in the art. Examples of olefin-unsaturated carboxylic reagent copolymers include poly(octene-co-ethylacrylate), poly (decene-co-butylmethacrylate), poly(hexene-co-maleic anhydride), poly(octene-co-methyl. fumarate) and the like.

In another embodiment, the polymer is a polyacrylate or polymethacrylate. The polyacrylates and polymethacrylates include homopolymers and interpolymers of one or more of the above described acrylic or methacrylic acids or esters. The polyacrylates and polymethacrylates include the Acryloid 1019 polymers, available from Rohm and Haas Company, Garbacryl 6335 available from Societe Francaise d'Organo-Sythese (SFOS), LZ 7720C available from The Lubrizol Corporation, and Viscoplex 0–101 polymers, available from Rohm Darmstadt.

In another embodiment, the polymer is a hydrogenated interpolymer of an vinyl-substituted aromatic compound and a conjugated diene. The interpolymers include diblock, triblock and random block interpolymers. The vinyl-substituted aromatic compounds generally have from about 8 to about 20, or from about 8 to about 18, or from about 8 to about 12 carbon atoms. Examples of vinyl-substituted aromatics include styrene, methylstyrene, o-methylstyrene, m-methylstyrene, p-methylstyrene, p-t-butylstyrene, with styrene being particularly useful. The conjugated dienes are described above. In one embodiment, isoprene and 1,3-butadiene are the conjugated dienes.

The vinyl-substituted aromatic content of these copolymers is in the range from about 20% to about 70%, or from about 40% to about 60% by weight. Thus, the conjugated diene content is in the range from about 30% to about 80%, or from about 40% to about 60% by weight. These interpolymers are prepared by conventional methods well known in the art. Such copolymers usually are prepared by anionic polymerization using, for example, an alkali metal hydrocarbon (e.g., sec-butyllithium) as a polymerization catalyst. Examples of suitable hydrogenated copolymers of a vinyl-substituted aromatic compound and a conjugated diene include Shellvis-40, and Shellvis-50, both hydrogenated styrene-isoprene block copolymers, manufactured by Shell Chemicals.

Fluidizing Agent

The lubricating compositions may additionally contain at least one fluidizing agent. Generally, the fluidizing agent is present in an amount up to about 30% by weight. Typically the fluidizing agent is present in an amount from about 3% to about 30%, or from about 5% to about 28%, from about 10% to about 27%, or from about 15% to about 25% by weight of the lubricating composition. The amount of fluidizing agent equals the total amount of fluidizing agents in the lubricating compositions.

In one embodiment, the fluidizing agent is at least one member selected from the group consisting of an alkylated aromatic hydrocarbon, a naphthenic oil, a poly"-olefin having a kinematic viscosity from about 3 to about 20 cSt at 100° C., a carboxylic acid esters, and mixtures of two or more thereof. The alkylated aromatic hydrocarbons typically include mono- or di-substituted benzenes wherein the substituents are hydrocarbon-based groups having from about 8 to about 30, or from about 10 to about 14 carbon atoms. An example is Alkylate A-215 (a 237 molecular weight alkylated benzene) and Alkylate A-230 (a 230 molecular weight alkylated benzene) available from Monsanto.

The naphthenic oils are those derived from naphthenic crudes such as found in the Louisiana area. The viscosity of such naphthenic oils at 40° C. generally is less than 4 centistokes and more generally within the range of from about 3.0 to about 3.8 centistokes. At 100° C. the viscosity of the desirable naphthenic crudes is within the range of about 0.8 to about 1.6 centistokes.

The poly-olefins (PAOs) are described above. Examples of useful PAOs include those derived from one or more of the above olefins, such as the olefins. These PAOs may have a viscosity from about 2 to about 30, or from about 3 to about 20, or from about 3 to about 8 cSt at 100° C. Examples of PAOs include 4 cSt poly-olefins, 6 cSt poly-olefins, and 8 cSt poly-olefins. A particularly useful PAO is derived from decene.

The carboxylic ester fluidizing agents are reaction products of dicarboxylic esters with alcohols having from about 1 to about 30, or from about 2 to about 18, or from about 3 to about 12 carbon atoms. The alcohols are described below and include methyl, ethyl, propyl, butyl, hexyl, heptyl, octyl, decyl and dodecyl alcohols. The dicarboxylic acids generally contain from about 4 to about 18, or from about 4 to about 12, or from about 4 to about 8 carbon atoms. Examples of dicarboxylic acids include phthalic acid, succinic acid, alkyl (C1–24)succinic acids, azelaic acid, adipic acid, and malonic acid. Particularly useful esters are dicarboxylic esters of C1–12 alcohols, such as esters of propyl, butyl, pentyl, hexyl, and octyl alcohols and azelaic acid. In one embodiment, the lubricating compositions contain less than about 20%, or less than about 15% by weight of carboxylic ester fluidizing agent.

The above-described mineral oil may be used with commercially available gear and transmission concentrates such as those sold by ExxonMobil, Lubrizol, and Ethyl corporations. In this embodiment, those commercial concentrates are diluted with the basestocks to form the transmission and gear formulations.

The combinations may be used in lubricants or in concentrates. The concentrate may contain the above combinations and/or other components used in preparing fully formulated lubricants. The concentrate also contains a substantially inert organic diluent, which includes kerosene, mineral distillates, or one or more of the oils of lubricating viscosity discussed herein. The combinations are present in a final product, blend, or concentrate in any amount effective to act as an antiwear, antiweld, and/or extreme-pressure agents in lubricating compositions.

In one embodiment, the lubricating compositions is free of sulfurized olefins and fatty acids or esters. In another embodiment, the lubricating composition is free of overbased metal. In another embodiment, the lubricating compositions is free of zinc dithiophosphates. In another embodiment, the lubricating composition is free of added lead compounds, such as lead napthanates, dithiophosphates and dithiocarbamates. In another embodiment, the lubricating composition is free of succinimides derived from olefins or polyolefins and ammonia or a mono-amine. In another embodiment, the lubricating composition is free of detergents or overbased metal salts of acidic organic compounds.

Other Additives

The invention also contemplates the use of other additives together with the above combinations. Such additives include, for example, detergents, corrosion- and oxidation-inhibiting agents, pour point depressing agents, extreme-pressure agents, antiwear agents, color stabilizers, anti-foam agents and mixtures thereof.

The detergents are exemplified by oil-soluble neutral and basic salts (i.e. overbased salts) of alkali or alkaline earth metals with sulfonic acids, carboxylic acids, phenols or organic phosphorus acids, such as those described above. The oil-soluble neutral or basic salts of alkali or alkaline earth metal salts may also be reacted with a boron compound. Examples of useful overbased and borated overbased metal salts include sodium, calcium and magnesium overbased and borated overbased sulfonates and carboxylates, including the above hydrocarbyl-substituted carboxylic acylating agents.

Auxiliary extreme-pressure agents and corrosion- and oxidation-inhibiting agents that may be included in the lubricants of the invention are exemplified by chlorinated aliphatic hydrocarbons such as chlorinated waxes; sulfurized alkylphenols; phosphosulfurized hydrocarbons, such as the reaction product of a phosphorus sulfide with turpentine or methyl oleate; metal thiocarbamates, such as zinc dioctyldithiocarbamate, and barium diheptylphenyl dithiocarbamate; and ashless dithiocarbamates such as reaction products of a dithiocarbamic acid and an unsaturated acid, ester, anhydride, amide, ether, or imide. Many of the above-mentioned extreme pressure agents and corrosion- and oxidation-inhibitors also serve as antiwear agents.

Pour point depressants are an additive often included in the lubricating oils described herein. Examples of useful pour point depressants are polymethacrylates; polyacrylates; polyacrylamides; condensation products of haloparaffin waxes and aromatic compounds; vinyl carboxylate polymers; and polymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715, incorporated by reference for their relevant disclosures.

It is understood that any of the above-described additives that are taught as potential ingredients may be restricted from the lubricating compositions.

The following examples relate to lubricating compositions containing thiadiazole.

EXAMPLE 1

An industrial gear oil is prepared by blending 0.1 parts of the product of Example P-3, 0.1 parts of the product of Example PS-3, 1.5 parts of the product of Example S-1, 0.1 parts of the product of Example D-4, and 0.01 parts of toyltriazole into an ISO 220 industrial gear basestock.

EXAMPLE 2

An industrial gear oil is prepared as described in Example 1 except 0.045 parts of 2,5-bis(tert nonyldithio) 1,3,4-thiadiazole is added to the industrial gear basestock.

The following table contains Examples 3–7 of industrial gear oils of the present invention. The industrial basestock is an ISO 220 industrial gear oil basestock.

| Example | 3 | 4 | 5 | 6 | 7 |
|---|---|---|---|---|---|
| Product of Example P-3 | 0.05 | 0.1 | — | 0.1 | — |
| Product of Example P-4 | 0.05 | — | 0.05 | — | 0.1 |
| Product of Example PS-1 | — | 0.1 | 0.15 | — | 0.1 |
| Product of Example PS-3 | 0.1 | — | — | 0.1 | — |
| Product of Example S-1 | — | 0.6 | 0.4 | 0.4 | 0.5 |
| Product of Example S-2 | 1.2 | 0.7 | 0.7 | 0.7 | 0.6 |
| Product of Example D-1a | 0.1 | — | 0.1 | 0.1 | 0.05 |
| Product of Example D-2 | — | 0.1 | — | — | 0.05 |
| Tolyltriazole | 0.01 | 0.02 | 0.008 | 0.01 | 0.01 |
| Thiadiazole[1] | — | 0.03 | 0.06 | 0.045 | — |
| Oleylamine | — | — | 0.008 | 0.008 | 0.008 |
| Pluradyne FL11[2] | — | — | 0.08 | 0.08 | 0.08 |
| Silicon antifoam agent | — | — | 0.018 | 0.018 | 0.018 |
| 100 neutral diluent oil | — | — | 0.67 | 0.67 | 0.67 |

1=2,5-bis(tertnonyldithio)1,3,4-thiadiazole

2=ethylene oxide-propylene oxide copolymer available from BASF

The following examples relate to automotive gear oil lubricating compositions.

EXAMPLE 8

An automotive gear oil is prepared by blending 0.35 parts of the product of Example P-3, 0.3 parts of the product of Example PS-3, 3.5 parts of the product of Example S-1, 0.5 parts of the product of Example D-4, and 0.04 parts of toyltriazole into an 75–90 automotive gear basestock.

EXAMPLE 9

An automotive gear oil is prepared as described in Example 8 except 0.07 parts of 2,5-bis(tert nonyidithio) 1,3,4-thiadiazole is added to the industrial gear basestock.

The following table contains Example 10–13 of automotive gear oils of the present invention. The automotive basestock is an SAE 75w-90 automotive gear oil basestock.

| Example | 10 | 11 | 12 | 13 | 14 |
|---|---|---|---|---|---|
| Product of Example P-3 | 0.15 | 0.3 | — | 0.3 | — |
| Product of Example P-4 | 0.15 | — | 0.1 | — | 0.1 |
| Product of Example PS-1 | — | 0.3 | 0.5 | — | 0.1 |
| Product of Example PS-3 | 0.3 | — | — | 0.3 | — |
| Product of Example S-1 | — | 1.7 | 1.2 | 1.2 | 1.95 |
| Product of Example S-2 | 3.5 | 1.8 | 2.1 | 2.1 | 1.45 |
| Product of Example D-1a | 0.5 | — | 0.1 | 0.45 | 0.05 |
| Product of Example D-2 | — | 0.3 | — | — | 0.05 |
| Tolyltriazole | 0.03 | 0.05 | 0.008 | 0.03 | 0.03 |
| Thiadiazole[1] | — | 0.05 | 0.06 | — | 0.045 |
| Oleylamine | — | — | 0.24 | 0.24 | 0.24 |
| Pluradyne FL11[2] | — | — | 0.024 | 0.024 | 0.024 |
| Silicon antifoam agent | — | — | 0.054 | 0.054 | 0.054 |
| 100 neutral diluent oil | — | — | 0.67 | 0.67 | 0.67 |

1=2,5-bis(tertnonyldithio) 1,3,4-thiadiazole

2=ethylene oxide-propylene oxide copolymer available from BASF

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising: (a) at least one sulfur-free hydrocarbyl phosphoric acid ester or salt, (b) at least one sulfur-containing hydrocarbyl phosphoric acid or salt, (c) an organic polysulfide, (d) at least one dispersant, (e) from about 0.01% to about 0.1% by weight of at least one triazole metal deactivator, and (f) from about 0.001% to about 5% of at least one thiadiazole metal deactivator.

2. The composition of claim 1 wherein each hydrocarbyl group independently contains from 1 to about 30 carbon atoms.

3. The composition of claim 1 wherein (a) is a phosphoric acid ester prepared by reacting a phosphorus acid or anhydride with at least one alcohol containing from 1 to about 30 carbon atoms, or salt of the phosphoric acid ester and wherein the alcohol contains from about 6 to about 18 carbon atoms.

4. The composition of claim 1 wherein (a) is a salt prepared by reacting the sulfur-free hydrocarbyl phosphoric acid ester with ammonia or an amine and wherein the amine is a tertiary aliphatic primary amine.

5. The composition of claim 1 wherein (b) is a sulfur containing hydrocarbyl phosphoric acid ester prepared by reacting a dithiophosphoric acid with an epoxide to form an intermediate, and the intermediate is further reacted with a phosphorus acid or anhydride.

6. The composition of claim 1 wherein (b) is the sulfur-containing hydrocarbyl phosphoric acid ester salt is prepared by reacting the sulfur-containing hydrocarbyl phosphoric acid ester with ammonia or an amine.

7. The composition of claim 1 wherein the organic polysulfide (c) is prepared from an unsaturated compound represented by the formula

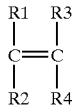

wherein each of R1, R2, R3 and R4 is independently hydrogen, hydrocarbyl, —C(R5)3, —COOR5, —CON(R5)2, —COON(R5)4, —COOM, —CN, —X, —YR5 or —Ar, wherein each R5 is independently hydrogen or hydrocarbyl group, with the proviso that any two R5 groups can be hydrocarbylene or substituted hydrocarbylene whereby a ring of up to about 12 carbon atoms is formed; M is one equivalent of a metal cation; X is halogen; Y is oxygen or divalent sulfur; Ar is an aryl or substituted aryl group of up to about 12 carbon atoms.

8. The composition of claim 7, wherein each R1, R2, R3 and R4 is independently hydrogen or a hydrocarbyl group containing from 2 to about 30 carbon atoms.

9. The composition of claim 1 wherein the organic polysulfide (c) is prepared from an olefin having from 2 to about 8 carbon atoms.

10. The composition of claim 1 wherein the dispersant (d) is at least one dispersant an acylated amine, a carboxylic ester, a Mannich reaction product, or a hydrocarbyl-substituted amine.

11. The composition of claim 1 wherein the dispersant (d) is at least one reaction product of a hydrocarbyl-substituted carboxylic acylating agent and a polyamine.

12. The composition of claim 1 wherein the dispersant (d) contains boron.

13. The composition of claim 1 wherein (e) is at least one benzotriazole and alkyl-substituted benzotriazoles containing up to 15 carbon atoms in the alkyl group.

14. The composition of claim 1 wherein (e) is tolyltriazole.

15. The composition of claim 1 wherein (f) is mono or disubstitued thiadiazole having a hydrocarbylthio group, a hydrocarbyidithio group, or mixture of these groups and each hydrocarbyl group independently contains from 1 to 30 carbon atoms in each hydrocarbyl group.

16. The composition of claim 11 wherein (a) is a hydrocarbyl phosphoric acid ester prepared by reacting a phosphorus acid or anhydride with at least one alcohol containing from about 4 to about 18 carbon atoms, or amine salt of the phosphoric acid ester.

* * * * *